US006745608B2

(12) United States Patent
Miura

(10) Patent No.: US 6,745,608 B2
(45) Date of Patent: Jun. 8, 2004

(54) HEMMING UNITS AND APPARATUS

(75) Inventor: Takahisa Miura, Aichi-ken (JP)

(73) Assignees: Shinkoh Co., Ltd., Aichi-Ken (JP); Hiroshi Watanabe, Gufu-Ken (JP)

( * ) Notice: Subject to any disclaimer, the term of this patent is extended or adjusted under 35 U.S.C. 154(b) by 0 days.

(21) Appl. No.: 10/016,775

(22) Filed: Dec. 10, 2001

(65) Prior Publication Data

US 2003/0106359 A1 Jun. 12, 2003

(51) Int. Cl.[7] ..... B21D 39/02; B21D 19/08
(52) U.S. Cl. ..... 72/306; 72/452; 29/243.58
(58) Field of Search ..... 72/312, 306, 451, 72/452, 387; 29/243.58, 243.57

(56) References Cited

U.S. PATENT DOCUMENTS

| | | | | | |
|---|---|---|---|---|---|
| 3,092,057 | A | * | 6/1963 | Warshilek | 29/243.58 |
| 3,143,095 | A | * | 8/1964 | Tribe | 29/243.58 |
| 4,346,579 | A | * | 8/1982 | Takatsu | 29/243.58 |
| 4,453,396 | A | | 6/1984 | Takatsu | 72/387 |
| 5,457,981 | A | * | 10/1995 | Brown et al. | 72/451 |
| 5,647,243 | A | * | 7/1997 | Zampini | 72/452.6 |
| 5,711,183 | A | * | 1/1998 | Mattsson | 72/451 |
| 5,735,162 | A | * | 4/1998 | Mattsson et al. | 72/451 |
| 5,740,691 | A | | 4/1998 | Kovarovic et al. | 72/306 |
| 5,784,919 | A | * | 7/1998 | Mattsson | 72/450 |
| 5,979,208 | A | | 11/1999 | Hartley | 72/306 |
| 6,089,074 | A | * | 7/2000 | Dorsett | 72/450 |
| 6,295,858 | B1 | | 10/2001 | Torito | 72/315 |
| 6,446,478 | B1 | | 9/2002 | Muller | 72/306 |
| 6,467,324 | B2 | | 10/2002 | Patrick | 72/312 |

FOREIGN PATENT DOCUMENTS

| | | | |
|---|---|---|---|
| GB | 958671 | * | 5/1964 |
| JP | 2-15830 | * | 1/1990 |
| JP | 11-150367 | | 5/1999 |
| JP | 2000-263159 | * | 9/2000 |

* cited by examiner

*Primary Examiner*—Daniel C. Crane
(74) *Attorney, Agent, or Firm*—Conley Rose, P.C.

(57) ABSTRACT

A hemming unit may include a hemming tool, an actuator for moving the hemming tool, and a link mechanism connecting the actuator and the hemming tool. Therefore, the hemming tool can be moved by the actuator by means of the link mechanism to perform a hemming operation. A hemming apparatus may include at least one hemming unit, a workpiece support for supporting a workpiece during the hemming operation, and a workpiece holder for holding the workpiece in position relative to the workpiece support during the hemming operation.

15 Claims, 16 Drawing Sheets

HEMMING UNITS AND APPARATUS

BACKGROUND OF THE INVENTION

1. Field of the Invention

The present invention relates to hemming units and apparatus that are used for hemming workpieces that may be formed into parts of various machines and apparatus, such as doors, hoods and trunk lids of automobiles.

2. Description of the Related Art

Japanese Laid-Open Patent Publication No. 7-232220 teaches a hemming apparatus that includes a press machine. An upper die and a lower die are mounted on the press machine. The upper die has a pre-hemming tool and a finish hemming tool. In order to hem a workpiece, the workpiece is positioned on the lower die, and then the upper die is lowered by the press machine by means of a press slide mechanism. As a result, the workpiece can be hemmed by the operation of the pre-hemming tool and the finish hemming tool. Further, in order to increase the number of workpieces that can be hemmed at one time, hydraulic cylinders may be optionally incorporated as auxiliary drive sources. However, because this type of hemming apparatus requires a press machine, a large-scale installation, including a pressing machine and upper and lower dies, is required. Therefore, installation costs are relatively high and a large installation space is required.

SUMMARY OF THE INVENTION

It is, accordingly, one object of the present invention to teach improved hemming units and apparatus that can be, e.g., installed at a lower cost and in a smaller space without sacrificing operability.

According to one aspect of the present teachings, hemming units are taught that comprise a hemming tool, an actuator for moving the hemming tool, and a link mechanism connecting the actuator and the hemming tool. In a representative embodiment, the link mechanism may include a parallel link mechanism and a toggle link mechanism. If the link mechanism is utilized in order to transmit the actuator force to the hemming tool, the actuator force can be amplified to apply an appropriate pressing force against the workpiece via the hemming tool. Therefore, the hemming tool may have a simple construction and can be manufactured at a relatively low cost.

In another representative embodiment, the hemming tool may be operated in a first mode for a pre-hemming operation and in a second mode for a finish hemming operation. Therefore, the pre-hemming operation and the finish hemming operation can be performed using the same hemming unit. Thus, it is not necessary to incorporate two separate hemming units that are respectively used for the pre-hemming and finish hemming operations. As a result, the manufacturing costs and the installation space can be substantially reduced.

Preferably, a chucking arm is connected to the toggle link mechanism, so that the chucking arm can apply a pressing force to a workpiece support that supports the workpiece in a direction opposite to the direction of the pressing force that is applied to the workpiece by the hemming tool. Because no substantial force is applied to the workpiece support to deform or bend the workpiece support, the workpiece support is not required to be highly rigid or have a large thickness in order to support the workpiece. Therefore, the workpiece support and its support legs as well as a base, on which the support legs are placed, may be relatively light weight. In addition, if the actuator that drives the hemming tool by means of the toggle mechanism actuates the chucking arm, an additional actuator is not required to actuate the chucking arm. Thus, manufacturing costs can be further reduced.

According to another aspect of the present teachings, hemming apparatus are taught that comprise, in addition to the hemming unit, a workpiece support for supporting the workpiece during a hemming operation, and a workpiece holder for holding the workpiece in position relative to the workpiece support.

In another representative embodiment, the hemming apparatus may include a plurality of hemming units that are disposed adjacent to the periphery of the workpiece support.

Additional objects, features and advantages of the present invention will be readily understood after reading the following detailed description together with the accompanying drawings and the claims.

DETAILED DESCRIPTION OF THE INVENTION

Figure 1:
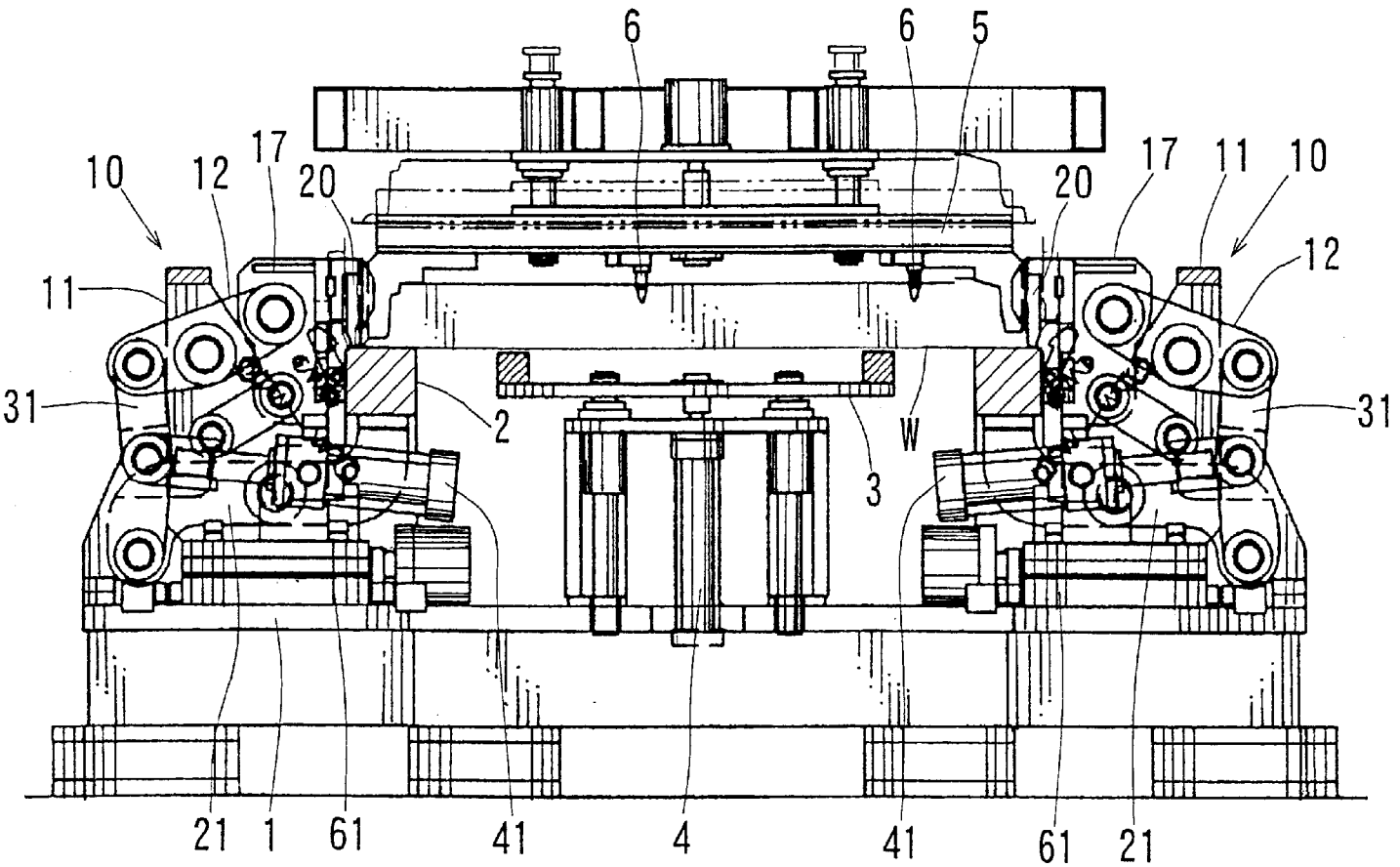
FIG. 1 is a schematic vertical sectional view of a first representative hemming apparatus.

In one representative embodiment, hemming units are taught that comprise a hemming tool, an actuator for moving the hemming tool, and a link mechanism connecting or coupling the actuator and the hemming tool. The hemming unit may include a unit frame for supporting the actuator and the link mechanism. If the actuator force is transmitted to the hemming tool by means of the link mechanism, the hemming tool can apply a sufficient force to the workpiece for the hemming operation. Thus, by appropriately determining the lever ratio of the link mechanism, the force of the actuator can be amplified to appropriately press the hemming tool against the workpiece.

In another representative embodiment, the link mechanism includes a parallel link mechanism and a toggle link mechanism. The parallel link mechanism may support the hemming tool. The toggle link mechanism may be connected between the actuator and the parallel link mechanism and may serve to amplify the driving force of the actuator.

By utilizing the parallel link mechanism, the actuator can move the hemming tool without changing or altering the orientation of the hemming tool during the movement. Therefore, the hemming operation by the hemming tool can be reliably performed. The toggle link mechanism may serve to amplify the driving force of the actuator that is transmitted to the hemming tool by means of the parallel link mechanism.

In another representative embodiment, the hemming tool may include a first surface for a pre-hemming operation of the workpiece and a second surface for a finish hemming operation of the workpiece. Further, the hemming unit is preferably operable in a first mode for the pre-hemming operation using the first surface and in a second mode for the finish hemming operation using the second surface.

In another representative embodiment, the hemming tool is adapted to hem a workpiece that is supported on a workpiece support. The hemming unit may further include a shift mechanism for shifting the hemming unit relative to the workpiece support between a first position for operating in the first mode and a second position for operating in the second mode. Therefore, a single hemming unit can perform the pre-hemming operation and the finish hemming operation.

In another representative embodiment, the workpiece may include a first portion having a peripheral portion. The workpiece may also include a second portion having a peripheral portion that extends outward of the peripheral portion of the first portion and is bent upward by an angle of substantially 90°. The actuator may move the hemming tool such that the peripheral portion of the second portion is bent over the peripheral portion of the first portion by a predetermined angle (e.g., about 45°). Then, the peripheral portion of the second portion, which was previously bent by the predetermined angle, is further bent so as to be tightly pressed or sealed against the peripheral portion of the first portion.

The hemming unit may further include a force canceling device that serves to apply a pressing force against the workpiece support in a direction substantially opposite to a pressing force applied to the workpiece support via the workpiece by the hemming tool during the hemming operation. Therefore, the pressing force applied to the workpiece support by the hemming tool can be canceled or offset. If no substantial force is applied to the workpiece support to deform or bend the workpiece support, the workpiece support is not required to be highly rigid or have a large thickness in order to support the workpiece.

In another representative embodiment, the actuator may also serve to drive the force canceling device. In this case, the force canceling device may apply the pressing force against the workpiece support substantially simultaneously with the application of the pressing force against the workpiece by the hemming tool. If the actuator that drives the hemming tool by means of the toggle mechanism that actuates the force canceling device, an additional actuator is not required to actuate the chucking arm.

The toggle link mechanism may include a first link member and a second link member that are respectively connected to the hemming tool and the force canceling device. Further, the parallel link mechanism may be connected between the hemming tool and the first link member of the toggle link mechanism.

In another representative embodiment, the force canceling device may include a chucking arm. A first end of the chucking arm may be connected to the second link member of the toggle link mechanism. A second end of the chucking arm may serve to contact the workpiece support in order to apply a suitable pressing force against the workpiece support.

In another representative embodiment, the hemming unit may have two separate hemming tools for a pre-hemming operation and a finish hemming operation, respectively. A mode change device may serve to change the positions of these hemming tools relative to each other in response to the transition from the pre-hemming mode to the finish hemming mode. Preferably, the mode change device also may include a second actuator and a second link mechanism, so that one of the hemming tools does not move to a position that will interfere with the hemming operation using the other hemming tool.

In another representative embodiment, the second link mechanism may be associated with the link mechanism for moving one of the hemming tool. Preferably, the hemming unit may include a fixed unit frame for supporting the actuator and the link mechanism.

In another aspect of the present teachings, hemming apparatus are taught that comprise, in addition to the hemming unit, a workpiece support for supporting the workpiece during a hemming operation and a workpiece holder for holding the workpiece in position relative to the workpiece support during the hemming operation. Optionally, the hemming unit is disposed adjacent to the periphery of the workpiece support. In addition, the workpiece support may optionally be mounted on a base and the actuator may be positioned in a space defined between the workpiece support and the base. Naturally, a plurality of hemming units may be disposed adjacent to the periphery of the workpiece support.

Each of the additional features and teachings disclosed above and below may be utilized separately or in conjunction with other features and teachings to provide improved hemming units and apparatus and methods for designing and using such hemming units and apparatus. A representative example of the present invention, which examples utilize many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention. Moreover, various features of the representative examples may be combined in ways that are not specifically enumerated in order to provide additional useful embodiments of the present teachings.

A representative embodiment of a hemming apparatus will now be described with reference to the drawings. Referring to FIG. 1, the representative hemming apparatus is shown in a vertical cross-sectional view. As shown in FIG. 1, the apparatus may include a support base 1, on which a workpiece support 2 is fixed in position. More specifically, a plurality of support legs, e.g., four support legs (not shown), may extend from the lower surface of the workpiece support 2 and may be secured to the support base 1. Preferably, the workpiece support 2 is formed by a die-casting process, so that the workpiece support 2 has a substantially rectangular frame-like configuration with a central opening in a plan view.

A lift 3 may be positioned within the central opening of the workpiece support 2 and may be driven up and down by the operation of a pneumatic cylinder 4 that is mounted on the base 1 in an upright position. The lift 3 may have an upper surface portion for supporting a workpiece W. The lift 3 may cooperate with a workpiece transfer device, such as a robot (not shown), so that the workpiece W can be set onto the workpiece support 2 or can be removed therefrom. Thus, in order to set or place the workpiece W onto the workpiece support 2, the lift 3 may be, e.g., lifted to a level or position above the upper surface of the workpiece support 2. Then, the workpiece W may be conveyed from the outside onto the lift 3 by the workpiece transfer device. Thereafter, the lift 3 may be lowered to a level or position below the upper surface of the workpiece support 2, so that the workpiece W is positioned on the upper surface of the workpiece support 2 as shown in FIG. 1.

Preferably, the upper surface of the workpiece support 2 and the upper surface of the lift 3 are respectively configured to correspond to the configuration of the workpiece W. However, the lower surface of the workpiece support 2 may be, e.g., a flat surface.

A workpiece holder 5 may be disposed upward of or above the workpiece support 2 and may serve to fix the workpiece W in position relative to the workpiece support 2 during a hemming operation. The workpiece holder 5 may be supported by a roof frame by means of one or more hydraulic cylinders (not shown), so that the workpiece holder 5 can move vertically between an upper rest position and a lower pressing position. In the lower pressing position, the hydraulic cylinder(s) may cause the workpiece holder 5 to press against the workpiece W. In an alternative embodiment (not shown), the workpiece holder 5 may be vertically pivotally supported by means of a swing arm, and a hydraulic cylinder (not shown) may serve to pivot the swing arm, so that the workpiece holder 5 can pivot between a rest position and a pressing position against the workpiece.

A plurality of positioning pins 6 may be secured to the lower surface of the workpiece holder 5 and may extend downward from the workpiece holder 5. The positioning pins 6 may preferably be arranged to correspond to positioning recesses or holes (not shown) defined in the workpiece W, as will be further discussed below.

Figure 2A:
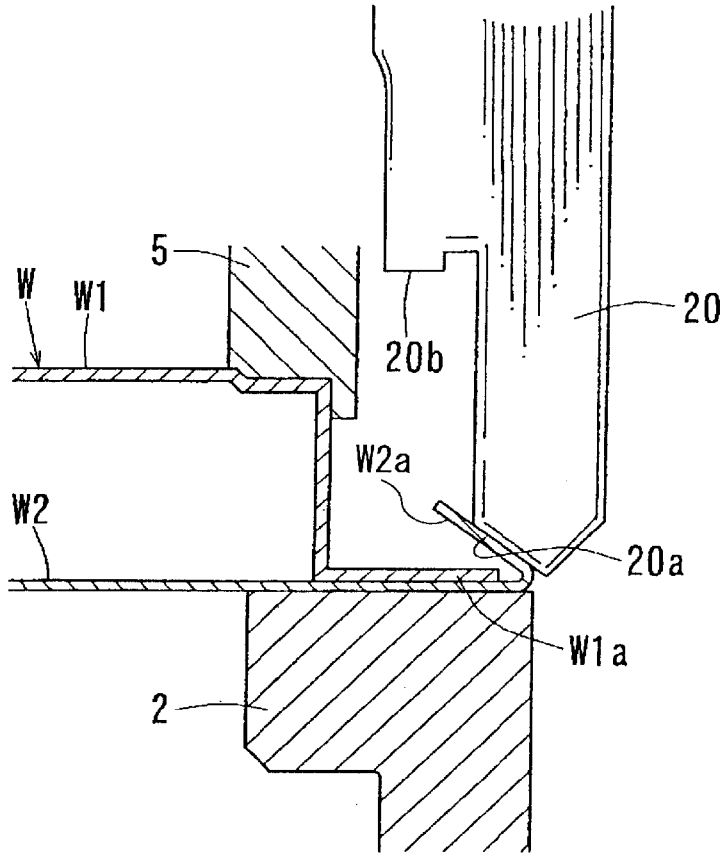
FIG. 2(A) is an enlarged sectional view showing a pre-hemming operation.
Figure 2B:
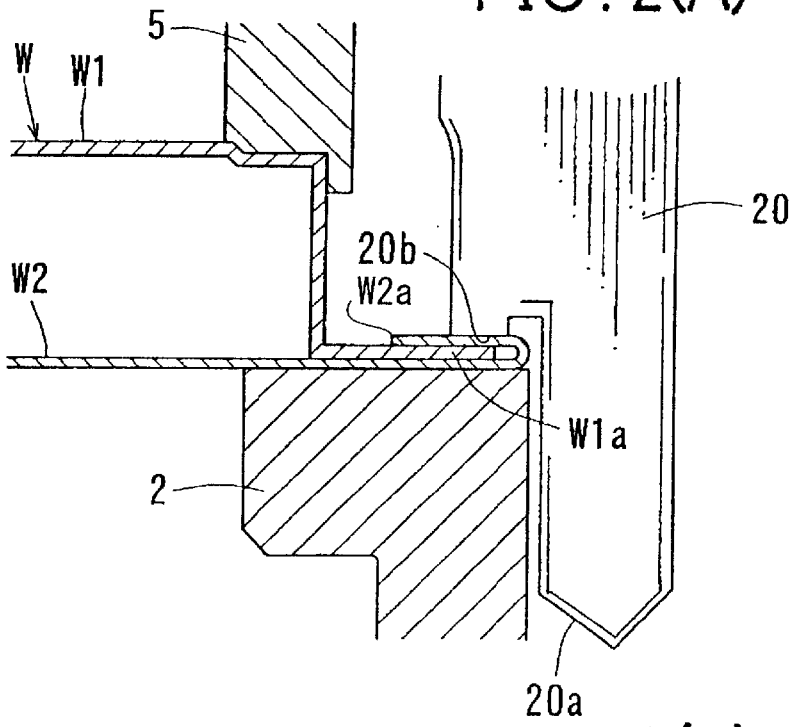
FIG. 2(B) is an enlarged sectional view showing a finish hemming operation.

FIGS. 2(A) and 2(B) schematically illustrate a pre-hemming operation and a subsequent finish hemming operation, respectively, that may be performed by a hemming tool 20 through cooperation with the workpiece support 2 and the workpiece holder 5. The workpiece W shown in FIGS. 2(A) and 2(B) may be a semi-finished part, such as an automobile door part or hood part, and may include, e.g., an inner panel W1 and an outer panel W2.

In this representative embodiment, the outer panel W1 and the inner panel W2 have been formed to have predetermined configurations, respectively, and have been joined to each other before the panels are supplied to the hemming apparatus. More specifically, the inner panel W2 may include a peripheral portion W2*a* that extends outward beyond a peripheral flange W1*a* of the outer panel W1 and is bent upward at a substantially right angle. Therefore, in this representative embodiment, the workpiece W is hemmed to seal the upright peripheral portion W2*a* of the outer panel W2 against the peripheral flange W1*a* of the inner panel W1.

As noted above, the hemming operation may comprise a pre-hemming operation or step and a finish hemming operation or step. In the pre-hemming operation, the upright peripheral portion W2*a* may be bent by an angle of about 45° over the peripheral flange W1*a* as shown in FIG. 2(A). The finish hemming operation is preferably subsequently performed to further bend the peripheral portion W2*a* by an angle of about 45° over the peripheral flange W1*a* as shown in FIG. 2(B). As a result, the peripheral portion W2*a* is sealed against the peripheral flange W1*a*.

In this representative embodiment, both the pre-hemming operation and the finish hemming operation can be performed using the same hemming tool 20. Thus, the hemming tool 20 may be configured to have a pre-hemming tool surface 20*a* and a finish hemming tool surface 20*b* that may be displaced from each other in both the vertical and horizontal directions. The pre-hemming tool surface 20*a* may be inclined by an angle of about 45° relative to the horizontal direction. Moreover, the finish hemming tool surface 20*b* may extend substantially in a horizontal direction.

The hemming apparatus may include, e.g., three hemming units 10 that are arranged along the periphery of the workpiece support 2 and are positioned on the front side, right side and left side of the workpiece support 2, respectively. The workpiece transfer device may be disposed on the rear side of the workpiece support 2. For the purpose of clarity and illustration, FIG. 1 only shows the right side and left side hemming units 10. Each of the hemming units 10 may be constructed to perform the hemming operation using the hemming tool 20 described above.

All the hemming units 10 may have substantially the same construction. Therefore, only the construction and the operation of the right side hemming unit 10 will be described with reference to FIGS. 3 to 9.

Figure 3:
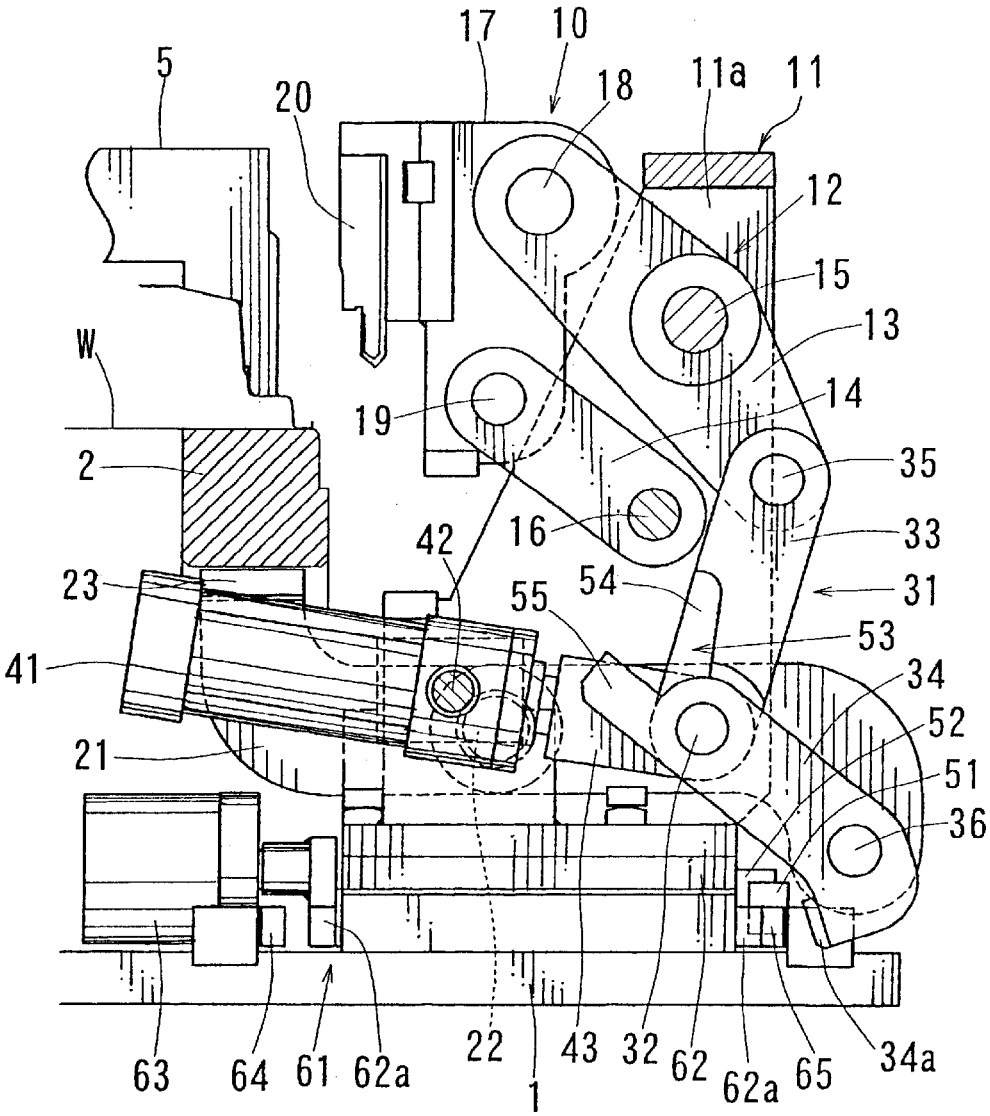
FIG. 3 is a side view of one of the hemming units of the hemming apparatus.

As shown in FIG. 3, the hemming unit 10 may comprise a hydraulic hemming cylinder 41, a parallel link mechanism 12, a chucking arm 21, a toggle link mechanism 31 and a unit bracket 11. The hemming cylinder 41 may serve as an actuator for moving the hemming tool 20. The parallel link mechanism 12 may serve to support the hemming tool 20 and to move the hemming tool 20 downward so as to press the hemming tool 20 against the workpiece W. The chucking arm 21 may serve to apply an upward pressing force to the workpiece support 2 during the hemming operation. The toggle mechanism 31 may serve to amplify the driving force of the hemming cylinder 41 and to transmit the amplified driving force to both the parallel link mechanism 12 and the chucking arm 21. The unit bracket 11 may serve to support these hemming unit elements. The hemming unit 10 may also include a shifting mechanism 61 that serves to shift the unit bracket 11 toward and away from the workpiece support 2 in the horizontal direction, so that the hemming tool 20 can be operated in either the pre-hemming mode or the finish hemming mode.

Figure 4:
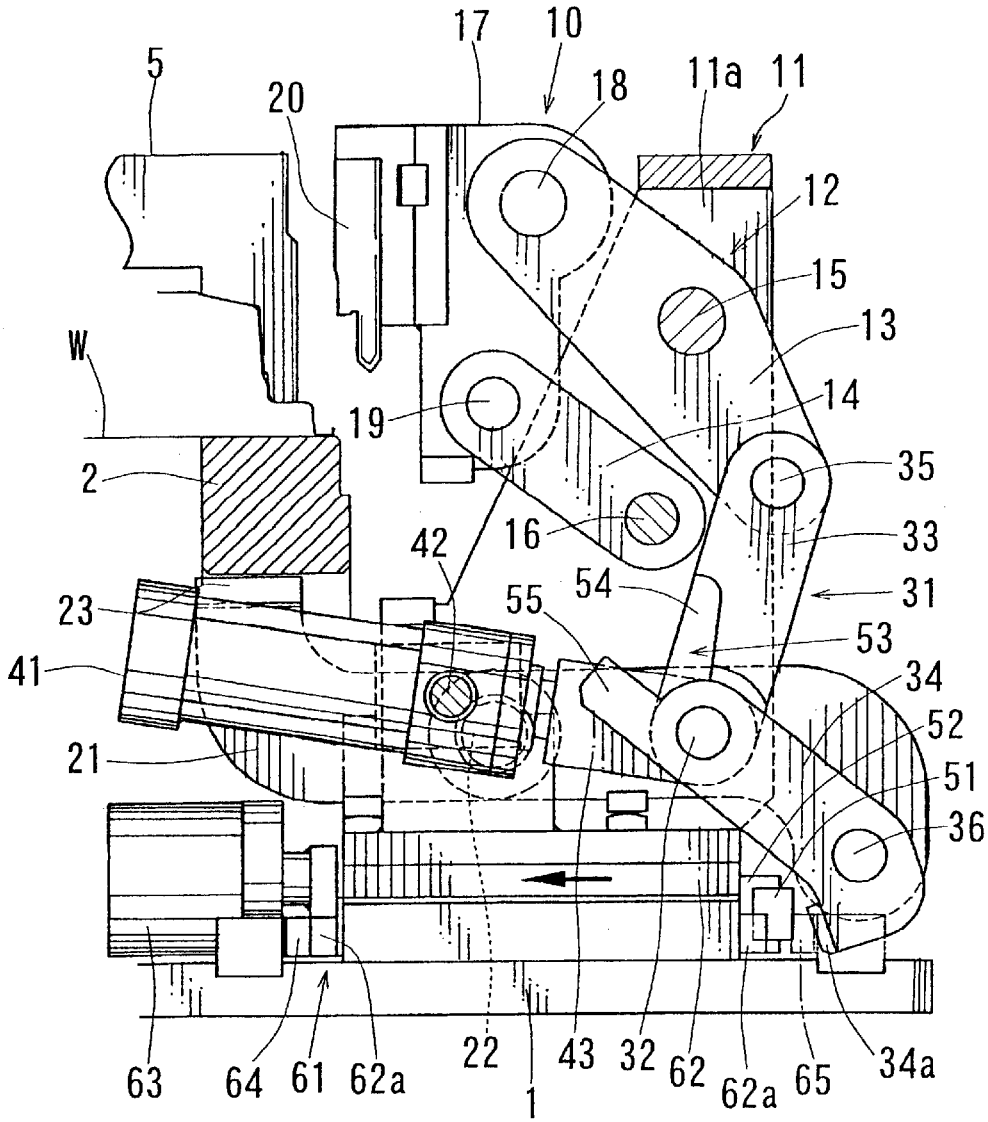
FIG. 4 is a view similar to FIG. 3, but instead, showing the hemming unit in a rest position before the pre-hemming operation.
Figure 5:
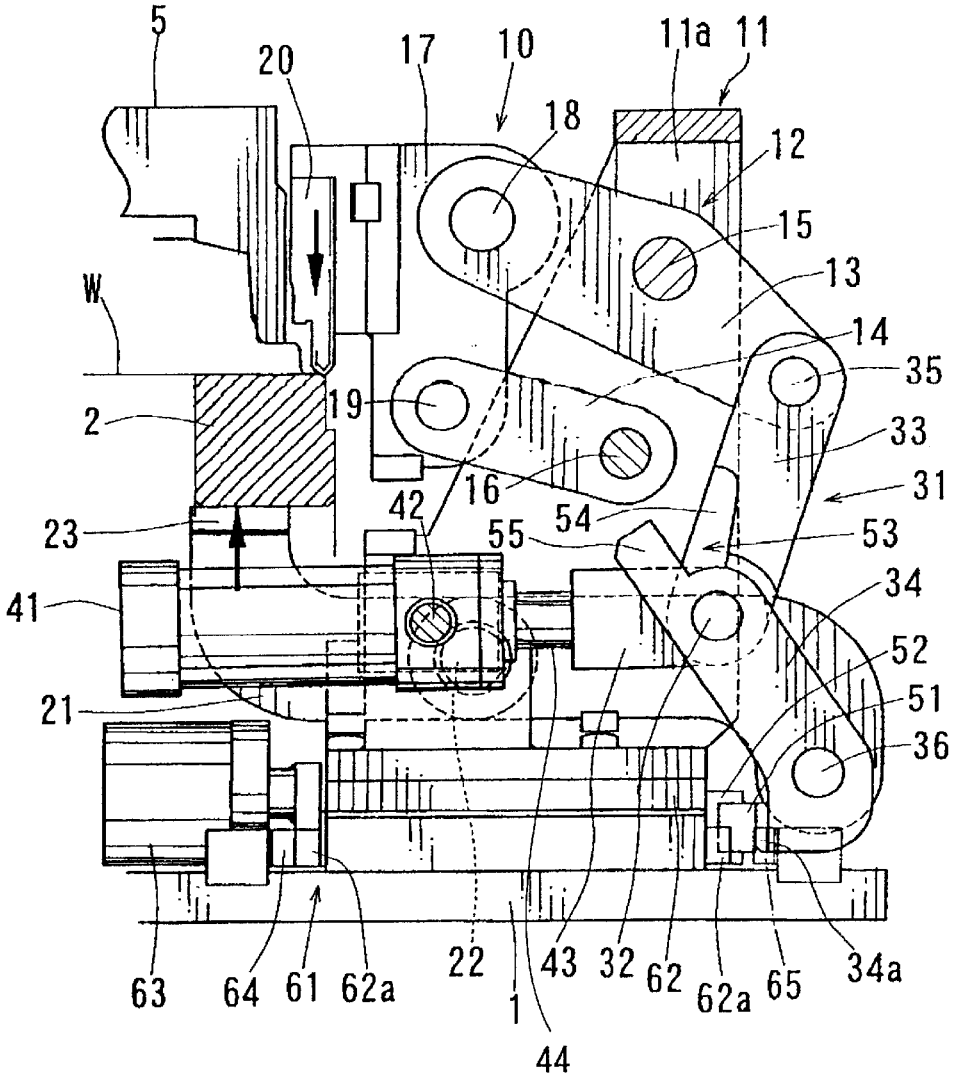
FIG. 5 is a view similar to FIG. 4, but instead, showing the pre-hemming operation performed by the hemming unit.
Figure 7:
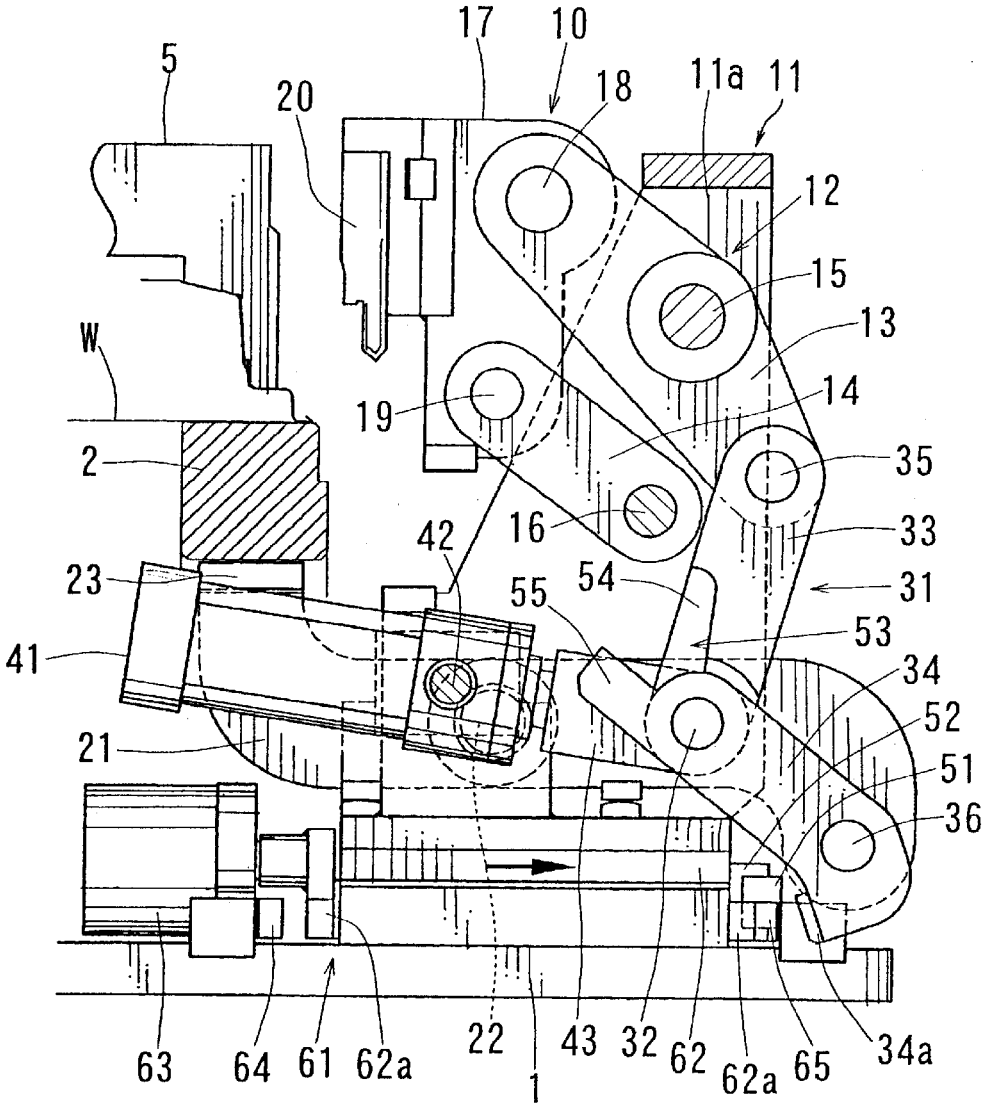
FIG. 7 is a view similar to FIG. 3, but instead, showing the hemming unit in a rest position before a finish hemming operation.
Figure 8:
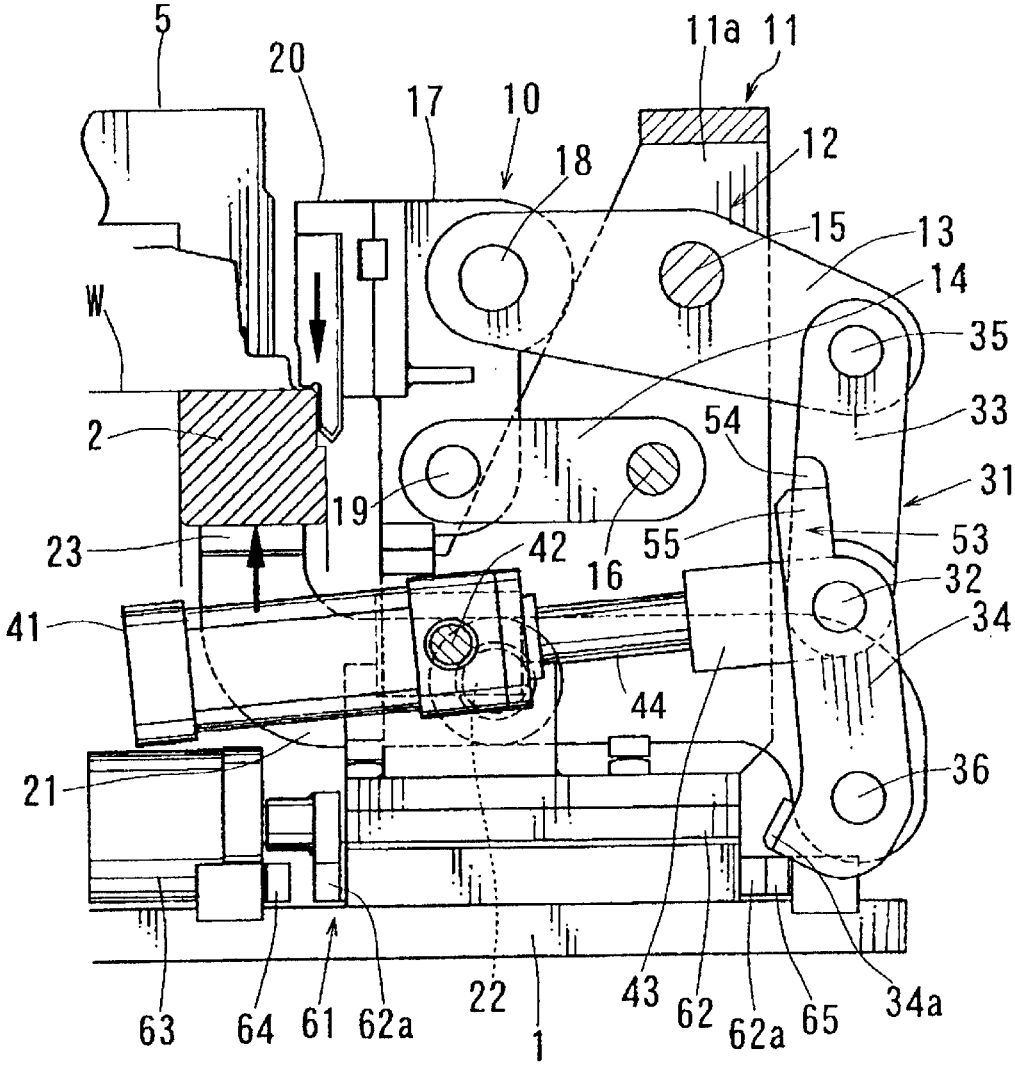
FIG. 8 is a view similar to FIG. 7, but instead, showing the finish hemming operation performed by the hemming unit.

The shifting mechanism 61 may comprise a slide table 62 that is slidably mounted on the base 1 of the hemming apparatus, so that the slide table 62 can move parallel (e.g., the horizontal direction) relative to the base 1 by means of a pneumatic cylinder 63 that is mounted on the base 1. The movable range of the slide table 62 may be limited by a table stopper mechanism that may include two stopper members 62*a* mounted on the right and left ends of the slide table 62, respectively. The table stopper mechanism also may include a first stop 64 and a second stop 65 that are mounted on the base 1 in positions opposing to the respective stopper members 62*a*. The first stop 64 and the corresponding stopper member 62*a* may define a first stop position on the side of the workpiece support 2 as shown in FIGS. 4 and 5. The second stop 65 and the corresponding stopper member 62*a* may define a second stop position that is located away from the workpiece support 2 as shown in FIGS. 7 and 8. The hemming unit 20 can operate in the pre-hemming mode in the first stop position, and can operate in the finish hemming mode in the second stop position.

The unit bracket 11 may comprise a pair of vertical plates 11*a* (only one vertical plate 11*a* is shown in the drawings) that are spaced from each other in the forward and rearward directions. The parallel link mechanism 12 may comprise upper and lower parallel link members 13 and 14. The link members 13 and 14 may be pivotally supported on the upper portion of the unit bracket 11 by means of support shafts 15 and 16, respectively, that extend between the upper portions of the vertical plates 11*a*. More specifically, a middle portion of the link member 13 in the longitudinal direction may be pivotally supported by the support shaft 15, and a lower end of the link member 14 may be pivotally supported by the support shaft 16. A tool holder 17 may be pivotally connected to both the link members 13 and 14. More specifically, an upper portion of the tool holder 17 may be pivotally connected to the upper end of the link member 13 by means of a pivot shaft 18. A lower portion of the tool holder 17 may be pivotally connected to the upper end of the link member 14 by means of a pivot shaft 19. The hemming tool 20 may be mounted on the left side of the tool holder 17 and may be held in a downwardly oriented position as viewed in FIG. 3.

A middle portion of the chucking arm 21 in the longitudinal direction may be pivotally supported on the lower portion of the unit bracket 11 by means of a support shaft 22 that extends between the lower portions of the vertical plates 11*a*. A left end of the chucking arm 21 may extend to a position adjacent to the lower surface of the workpiece support 2. A presser plate 23 may be secured to the left end of the chucking arm 21 and may oppose to the lower surface of the workpiece support 2. In the state shown in FIG. 3, the presser plate 23 may be spaced from the lower surface of the workpiece support 2 by a relatively small distance or clearance.

The toggle link mechanism 31 may comprise a pair of upper and lower link members 33 and 34 that are disposed between the vertical plates 11*a* of the unit bracket 11 and may be arranged in a V-shape with the open side oriented rightward as viewed in FIG. 3. A lower end of the link member 33 and an upper end of the link member 34 may be pivotally connected to each other by means of a joint shaft 32, so that the link members 33 and 34 can pivot relative to each other about the joint shaft 32. An upper end of the link member 33 may be pivotally connected to the lower end of the upper link member 13 of the parallel link mechanism 12 by means of a joint shaft 35. A lower end of the link member 34 may be pivotally connected to a right end of the chucking arm 21 by means of a joint shaft 36.

A support shaft 42 that extends between the vertical plates 11*a* of the unit bracket 11 may pivotally support the hemming cylinder 41. A knuckle 43 may be secured to one end of a piston rod 44 of the hemming cylinder 41 and may be pivotally connected to the joint shaft 32 that connects the link members 33 and 34 of the toggle mechanism 31, so that the hemming cylinder 41 extends substantially in parallel to the base 2 (e.g., the horizontal direction).

Therefore, the extending and retracting movement of the piston rod 44 of the hemming cylinder 41 or the drive force of the hemming cylinder 41 may be transmitted to the parallel link mechanism 12 via the joint shaft 32 and the upper link member 33 of the toggle link mechanism 31. The drive force of the hemming cylinder 41 also may be transmitted to the chucking arm 21 via the joint shaft 32 and the lower link member 34 of the toggle link mechanism 31. As a result, the hemming tool 20 can move between the rest position shown in FIG. 4 and the pre-hemming position shown in FIG. 5. In addition or in the alternative, the hemming tool 20 can move between the rest position shown in FIG. 7 and the finish hemming position shown in FIG. 8. Moreover, the chucking arm 21 can move between the release position shown in FIG. 4 (or FIG. 7) and the pressing position shown in FIG. 5 (or FIG. 8) in order to apply an upward pressing force to the lower surface of the workpiece support 2.

In order to limit the lower stroke end (operation stop position) of the hemming tool 20 during the hemming operation, a first stopper mechanism and a second stopper mechanism may be provided and may serve to restrain the lower stroke end of the hemming tool 20 during the operation in the pre-hemming mode and in the finish hemming mode, respectively.

The first stopper mechanism may include a stopper block 51 and a stopper plate 34*a*. A substantially C-shaped guide member 52 that is mounted on the right side of the slide table 62 may slidably receive the stopper block 51. A pneumatic cylinder (not shown) also may be mounted on the slide table 62 and may serve to shift the stopper block 51 in the forward and rearward directions relative to the guide member 52 between a first position and a second position. The stopper plate 34*a* may be mounted on the lower end of the lower link member 34 of the toggle mechanism 31 in a position opposite to the stopper block 51 when the stopper block 51 is in the first position. Therefore, the stopper plate 34*a* can abut the stopper block 51 as the link member 34 pivots in a clockwise direction as viewed in FIG. 3. The stopper plate 34*a* preferably does not oppose to the stopper block 51 when the stopper block 51 is in the second position.

The second stopper mechanism may include a recess 54 formed in the upper link member 33 of the toggle link mechanism 33 and an extension 55 formed on the lower link member 34. The recess 54 may be formed in the left side portion of the upper link member 33 in a position adjacent to the joint shaft 32. Further, the extension 55 may extend upward from the upper end of the lower link member 34. Therefore, as the link member 34 pivots in a clockwise direction as viewed in FIG. 3, the extension 55 may enter the recess 54 and may abut the bottom of the recess 54, so that the lower link member 34 cannot pivot further in the clockwise direction.

Although not shown in the drawings, two sets of the link members 13 and 14 of the parallel link mechanism 12, the chucking arm 21 and the link members 33 and 34 of the toggle mechanism 31 may be provided, so that these two sets are positioned forward or rearward relative to each other and between the vertical plates 11*a* of the unit bracket 11.

A representative method for operating the above representative hemming apparatus will now be described. First, a workpiece W may be transferred onto the workpiece support 2 as shown in FIG. 1. As described above, the lift 3 cooperates with the work transfer device and may be moved upward and downward to position the workpiece W on the upper surface of the workpiece support 2. Then, the workpiece holder 5 moves downward to press the workpiece W against the workpiece support 2 and to bring the positioning pins 6 into engagement with the corresponding positioning holes (not shown) formed in the inner panel W1 of the workpiece W. Thus, the workpiece W may be held in this manner until the hemming operation is completed. Preferably, when the workpiece W is being transferred onto the workpiece support 2, each of the hemming unit 10 is maintained in the rest position shown in FIG. 3, so that the workpiece W does not interfere with the hemming tool 20.

After the workpiece W has been set or placed onto the workpiece support 2, the hemming units 10 that are disposed on the front, right and left sides of the workpiece support 2 and may simultaneously start to perform the pre-hemming operation and the finish hemming operation in synchronism with each other. Because the operations performed by the hemming units 10 may be the same, the operation of only one hemming unit 10 will be explained.

In order to perform the pre-hemming operation, the pneumatic cylinder 63 is actuated to move the slide table 62 toward the workpiece support 2 until the left side stopper member 62*a* contacts the first stop 64. Thus, the hemming unit 10 can be set to the pre-hemming mode as shown in FIG. 4.

Then, the hemming cylinder 41 is actuated to extend the piston rod 44, as shown in FIG. 5, so that the joint shaft 32 of the toggle link mechanism 31 is moved rightward. Therefore, the link members 33 and 34 will simultaneously pivot about the joint shaft 32 in the counterclockwise direction and the clockwise direction, respectively. As the link member 33 pivots, the link member 13 of the parallel link mechanism 12 pivots in the counterclockwise direction about the support shaft 15, so that the hemming tool 20 moves downward toward the workpiece support 2 as shown in FIG. 5. As a result, the pre-hemming surface 20*a* of the hemming tool 20 contacts the peripheral portion W2*a* of the outer panel W so as to bend the peripheral portion W2*a* as shown in FIG. 2(A).

On the other hand, as the link member 34 pivots, the chucking arm 21 pivots about the support shaft 22 in the clockwise direction as viewed in FIG. 4, so that the presser plate 23 contacts the lower surface of the workpiece support 2 to apply upward pressure against the workpiece support 2. Therefore, the pre-hemming operation by the hemming tool 20 can be performed while the backup pressure is applied to the workpiece support 2 in order to cancel or match the pressure applied to the workpiece W by the hemming tool 20.

Figure 6:
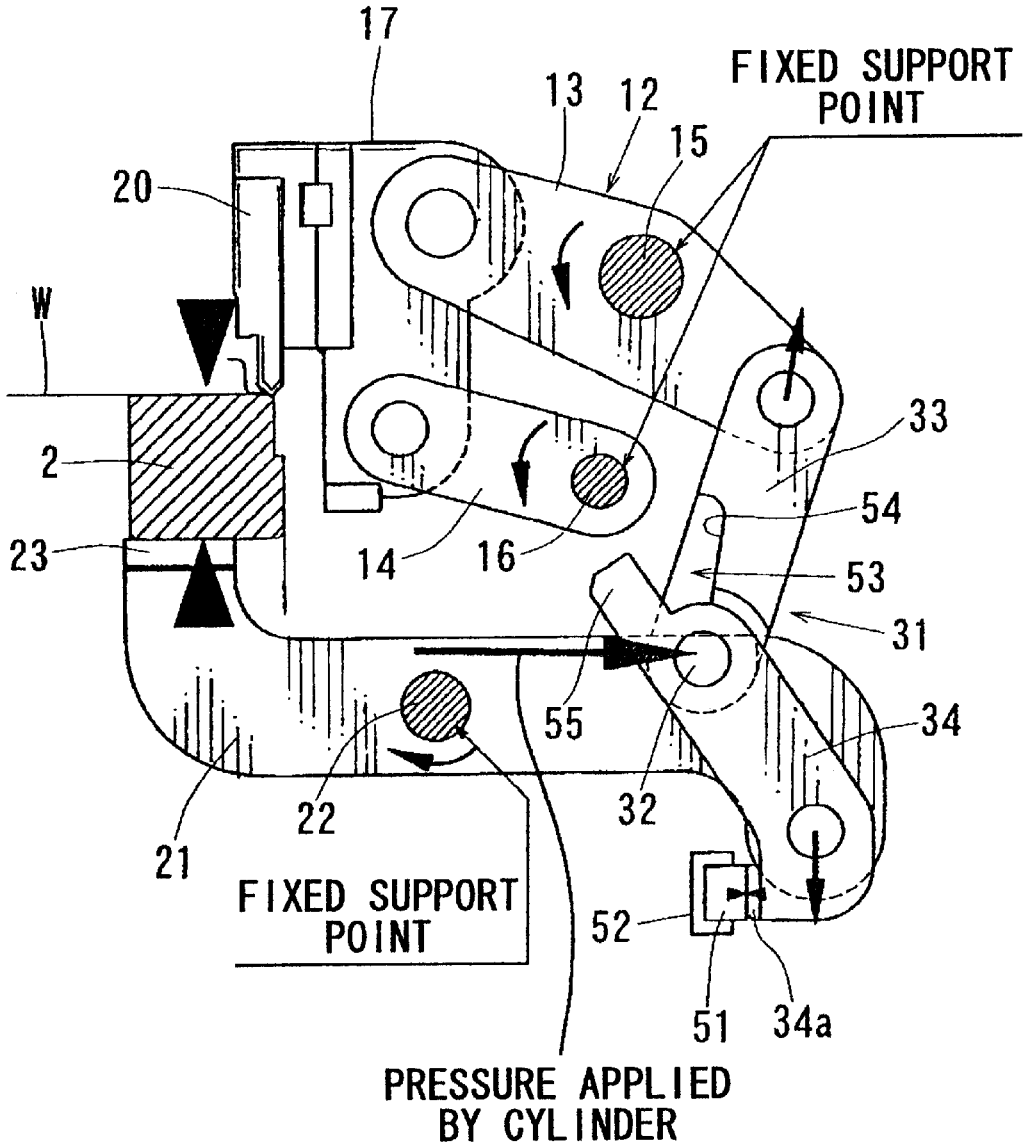
FIG. 6 is schematic diagram illustrating the pre-hemming operation.

When the pre-hemming operation has been completed, the stopper plate 34*a* of the lower link member 34 contacts the stopper block 51, as shown in FIG. 5, Therefore, the downward movement of the hemming tool 20 can be stopped at an appropriate level. FIG. 6 schematically shows the hemming unit 10 during the pre-hemming operation.

After completion of the pre-hemming operation, the piston rod 44 of the hemming cylinder 41 retracts, so that the hemming tool 20 and the presser plate 23 return to the respective rest positions shown in FIG. 4. Thereafter, in order to perform the finish hemming operation, the pneumatic cylinder 63 is actuated to move the slide table 62 rightward away from the workpiece support 2 until the right side stopper member 62*a* abuts the second stop 65. As a result, the hemming unit 10 is set to the finish hemming mode as shown in FIG. 7.

Further, the stopper block 51 for determining the lower stroke end of the hemming tool 20 during the pre-hemming operation is shifted by the pneumatic cylinder along the guide member 52. Thus, the stopper block 51 is moved to a position that does not oppose the stopper plate 34*a* of the lower link member 34 of the toggle link mechanism 31.

The hemming cylinder 41 is then actuated to extend the piston rod 44 as shown in FIG. 8. As a result, the link member 13 of the parallel link mechanism 12 and the chucking arm 21 will pivot by means of the toggle link mechanism 31 in a manner similar to the pre-hemming operation. Therefore, the finish hemming surface 20*b* of the hemming tool 20 may contact the peripheral portion W2*a* of the outer panel W2 of the workpiece W so as to further bend the peripheral portion W2*a* over the flange portion W1*a* of the inner panel W1 as shown in FIG. 2(B). At the same time, the presser plate 23 of the chucking arm contacts the lower surface of the workpiece support 2 to apply upward pressure against the workpiece support 2.

Figure 9:
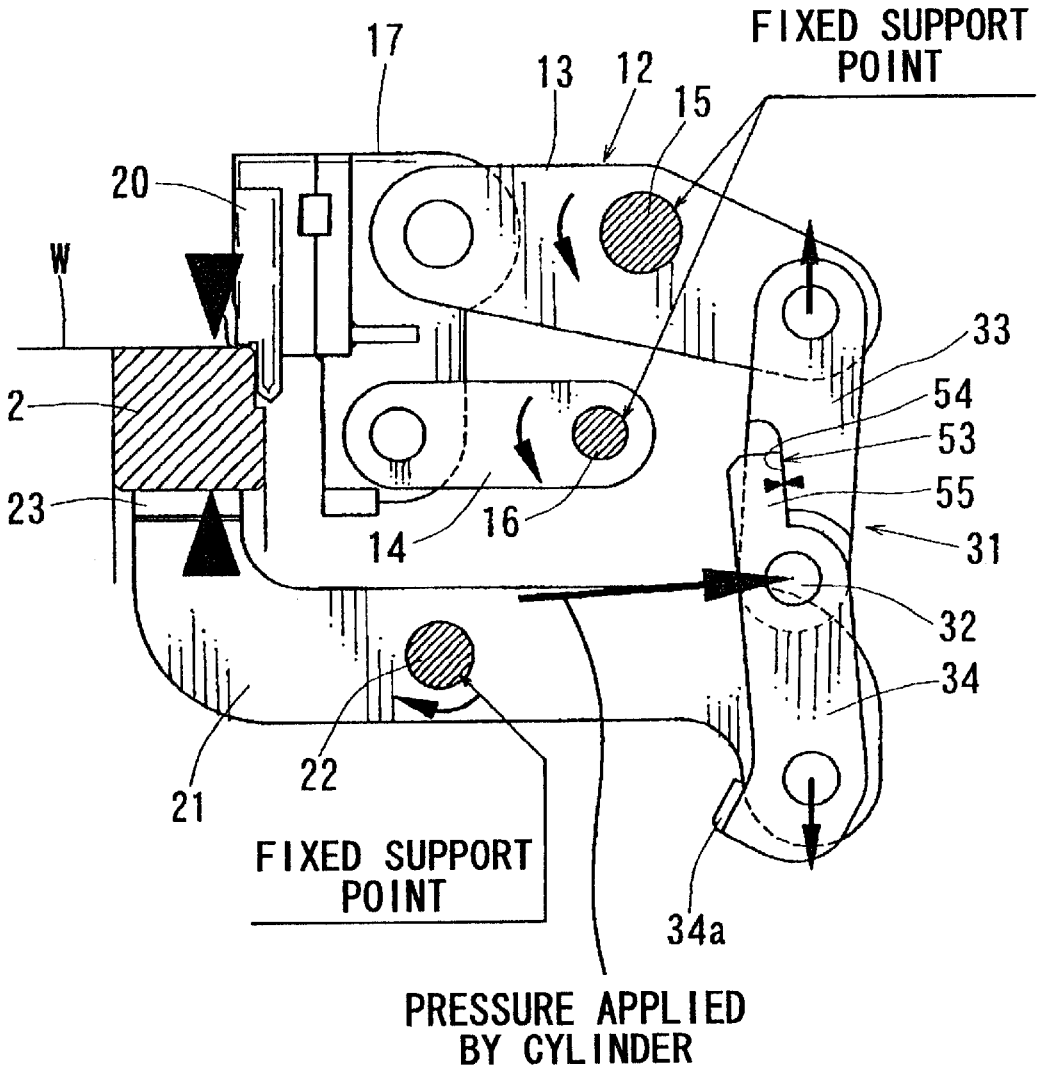
FIG. 9 is schematic diagram illustrating the finish hemming operation.

When the finish hemming operation has been completed, the extension 55 of the lower toggle link member 55 will enter the recess 54 of the upper toggle link member 54 and will contact the bottom of the recess 54. Therefore, the downward movement of the hemming tool 20 can be stopped at an appropriate level. FIG. 9 schematically shows the hemming unit 10 during the finish hemming operation.

After completion of the finish hemming operation, the piston rod 44 of the hemming cylinder 41 retracts, so that the hemming tool 20 and the presser plate 23 return to the respective rest positions shown in FIG. 7. In addition, the stopper block 51 returns to the initial position shown in FIG. 3 so as to again oppose to the stopper plate 34*a* of the lower link member 34 of the toggle mechanism 31 for the next hemming cycle.

Then, the workpiece holder 5 is raised to release the workpiece W, and the lift 3 moves upward to lift the workpiece W from the workpiece support 2. When the workpiece W has been lifted to a predetermined level, the work transfer device may be operated to remove the workpiece W from the hemming unit 10.

As described above, according to the representative hemming apparatus, three hemming units 10 are disposed along the periphery of the workpiece support 2, and the hemming operations are simultaneously performed by the respective hemming units 10 along the front, right and left sides of the workpiece W. Therefore, the hemming apparatus may be manufactured at a lower cost and may occupy a smaller installation space than known hemming apparatus that incorporate press machines.

In particular, in the representative hemming apparatus, the pre-hemming and the finish hemming operations can be performed by the hemming tool 20 while the workpiece support 2 is supported by the chucking arm 21. Thus, the pressure applied by the hemming tool 20 to the workpiece support 2 can be cancelled or matched by the pressure applied to the workpiece support 2 by the chucking arm 21. Therefore, the workpiece support 2 may have a relatively thin thickness in the vertical direction and may have a relatively few number of support legs, such as four support legs. Moreover, the hemming operation can be accurately and reliably performed without causing deformation of the workpiece support 2 due to the influence of the pressure applied by the hemming tool 20. Further, the base 1 that supports the support legs also may have a small thickness and a light weight. Therefore, the entire hemming apparatus may be relatively light weight, so that the hemming apparatus can be easily moved and installed.

Furthermore, because the workpiece support 2 may have a relatively small size, the die-cast mold that is used to form the workpiece support 2 also may have a relatively small size. Therefore, the manufacturing cost of the mold, including the material cost of the mold, can be reduced.

In addition, by utilizing the toggle link mechanism 31 that is connected to the parallel link mechanism 12 on one side and to the chucking arm 21 on the other side, the hemming operation by the hemming tool 20 and the backup operation of the workpiece support 2 can be realized with a single hemming cylinder 41 that drives the toggle link mechanism 31. Therefore, the number of necessary drive devices for these operations can be reduced. In addition, because the drive force applied by the hemming cylinder 41 can be amplified by the toggle mechanism 31, a cylinder having a relatively small diameter can be used as the hemming cylinder 41. Further, because the space formed between the workpiece support 2 and the base 1 is utilized to position the hemming cylinder 41, each of the hemming units 10 can be positioned immediately adjacent to the workpiece support 2. As a result, the entire hemming apparatus may have a relatively compact configuration.

Although the hemming apparatus of the above representative embodiment is adapted to hem the workpiece W to form an automobile door, the same hemming apparatus can be used to hem a variety of types of workpieces, such as engine hoods and trunk lids of automobiles and various parts of machines and apparatus other than automobiles.

The above representative hemming apparatus can be further modified in various ways. Such modifications may include changing the arrangement of the hemming cylinder 41, the omitting the toggle mechanism 31, and/or replacing the hemming cylinder 41 or the pneumatic cylinder 63 with a motor driven actuator. For example, the hemming cylinder 41 may be replaced with an electric motor and a crank mechanism that may convert the rotation of the motor into linear movement, which movement may then be transmitted to the toggle mechanism 31. The electric motor may provide superior maintenance qualities, because an electric motor does not require the use of hydraulic fluid, which could leak. In addition, environmental problems may be minimized, because it is not necessary to dispose of waste hydraulic fluid. Further, an electric motor can efficiently utilize energy, because it is not necessary to always drive the electric motor. Furthermore, an electric motor may operate more quickly, thereby reducing noise during the hemming operation.

In addition, two actuators can respectfully and separately drive the hemming tool 20 and the chucking arm 21. Further, although the pre-hemming operation and the finish hemming operation of the above representative embodiment are performed by a single hemming unit 10 that has a single hemming tool 20, the pre-hemming operation and the finish hemming operation may be separately performed by single-purpose units having a pre-hemming tool and a finish hemming tool, respectively.

Furthermore, although a slide mechanism 61 having a slide table 62 was utilized in the representative embodiment, a variety of means for shifting the position of the hemming tool relative to the workpiece may be utilized. For example, the hemming tool may be rotated or shifted in position without moving the workpiece in order to align the finishing surface of the hemming tool with the peripheral portion of the workpiece that will be bent in the finish hemming operation.

A second representative embodiment will now be described with reference to FIGS. 10 to 15. In these figures, like members are given the same reference numerals as the first representative embodiment and overlapping description will be omitted.

Figure 10:
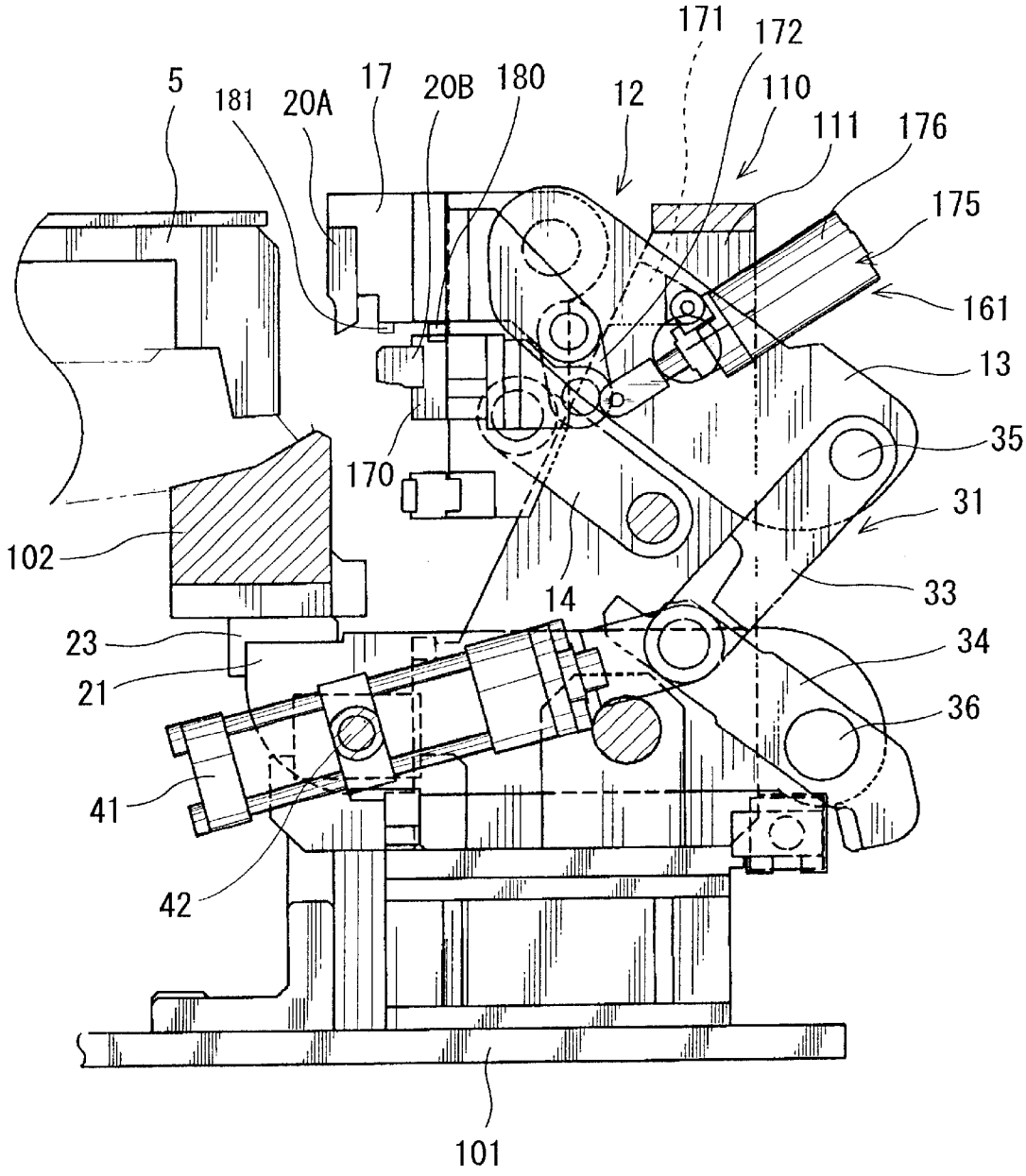
FIG. 10 is a side view of the rest position of one of the hemming units of a second representative hemming apparatus.

A hemming apparatus according to the second representative embodiment may include three hemming units 110 (only one hemming unit 110 is shown in FIG. 10). Although not shown in the drawings, the three hemming units 110 may be respectively disposed on the front side, the right side and left side of a workpiece support 102 in the same manner as the first representative embodiment.

The hemming unit 110 of this second representative embodiment may be the substantially same as the first representative embodiment with the following modifications:

(1) Two separate hemming tools including a finishing hemming tool 20A and a pre-hemming tool 20B are utilized instead of the single hemming tool 20 of the first representative embodiment.

(2) A unit bracket 111, which substantially corresponds to the unit bracket 11 of the first representative embodiment, is fixed in position relative to a support base 101.

(3) A mode change device 161 is utilized instead of the shifting mechanism 61 of the first representative embodiment. The mode change device 161 is operable to change the relative position of the finish hemming tool 20A and the pre-hemming tool 20B and may also serve as a means for shifting the position of the hemming tools 20A, 20B with respect to the workpiece W (or WA) in order to first perform a pre-hemming operation using the pre-hemming tool 20A and then perform a finish hemming operation using the finish hemming tool 20A.

In other respects, the second representative embodiment may be substantially the same as the first representative embodiment. Thus, the hemming cylinder 41 may be supported on the unit bracket 111 and may serve to actuate the toggle mechanism 31 that may include the upper and lower link members 33 and 34. The actuation of the toggle mechanism 31 may then be transmitted to move the chucking arm 21 and the parallel link mechanism 12.

In this second representative embodiment, the finish hemming tool 20A may be mounted on the tool holder 17 in the same manner as the hemming tool 20 of the first representative embodiment. On the other hand, as will be seen from FIGS. 11(A), 11(B) and 13, the pre-hemming tool 20B may be mounted on a second tool holder 170 that is separate and distinct from the tool holder 17. The second tool holder 170 may be pivotally supported by a support plate 171 by means of a bracket 172. Preferably, the support plate 171 may have a substantially triangular configuration and may be formed integrally with the rear portion of the tool holder 17. The bracket 171 may be pivotally connected to a lower side of a middle portion in the longitudinal direction of the support plate 171 by means of a pivot shaft 173. The middle portion in the longitudinal direction of the tool holder 170 may be pivotally connected to the bracket 172 by means of a pivot shaft 174.

A hydraulic or a pneumatic cylinder 175 may, e.g., serve as the mode change device 161 and may be connected between one end of the second tool holder 170, which is opposite to the pre-hemming tool 20B, and a tapered rearmost end of the support plate 171. More specifically, the cylinder 175 may have a cylinder body 176 and a piston rod 178 that extends from the cylinder body 176. The lateral side of the front end of the cylinder body 176 may be pivotally supported by the rear end of the support plate 171 by means of a pivot shaft 177. The front end of the piston rod 178 may be pivotally connected to the rear end of the second tool holder 170 by means of a pivot pin 179.

Figure 11A:
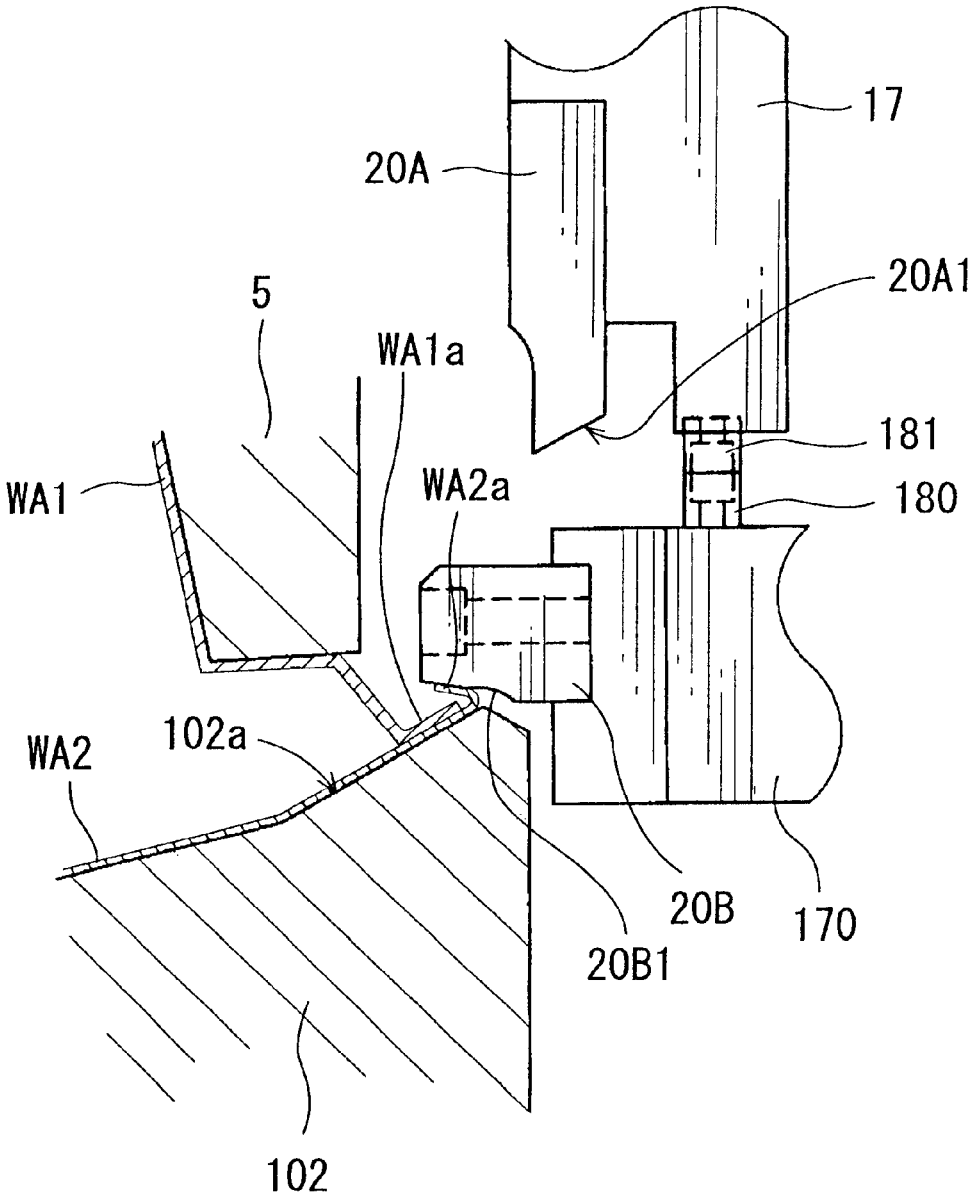
FIG. 11(A) is an enlarged sectional view showing the pre-hemming operation of the second representative hemming apparatus.
Figure 11B:
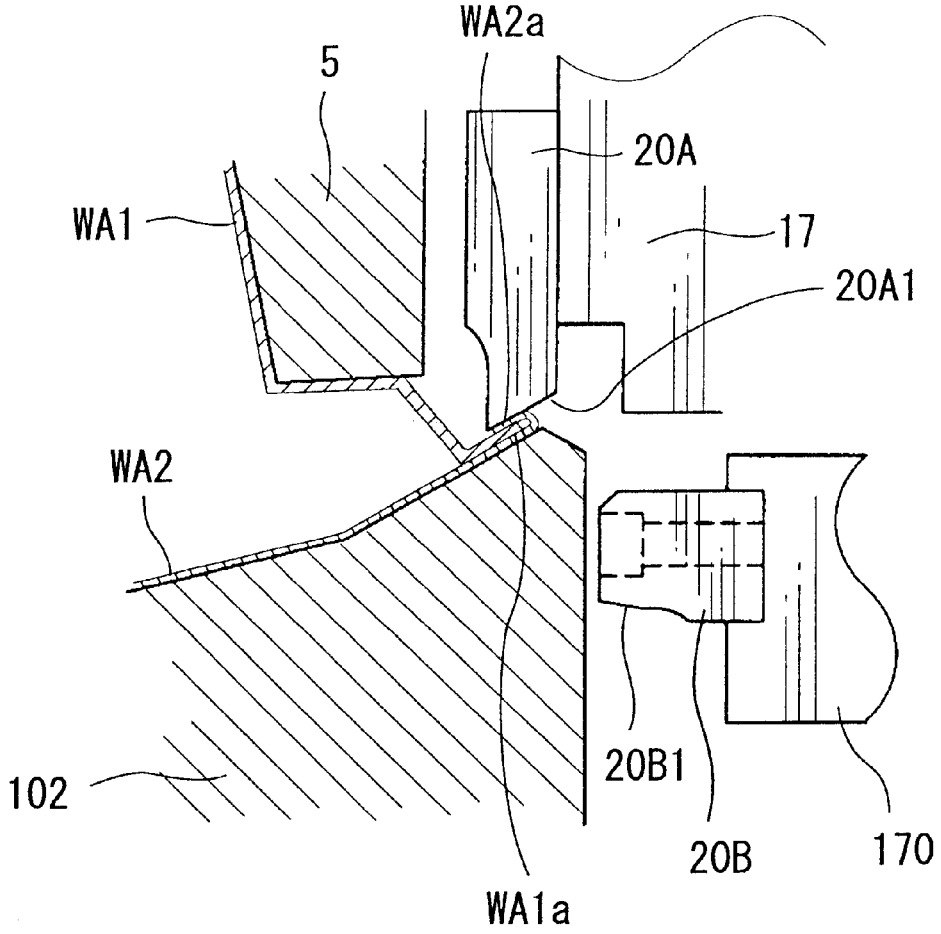
FIG. 11(B) is an enlarged sectional view showing the finish hemming operation of the second representative hemming apparatus.
Figure 12:
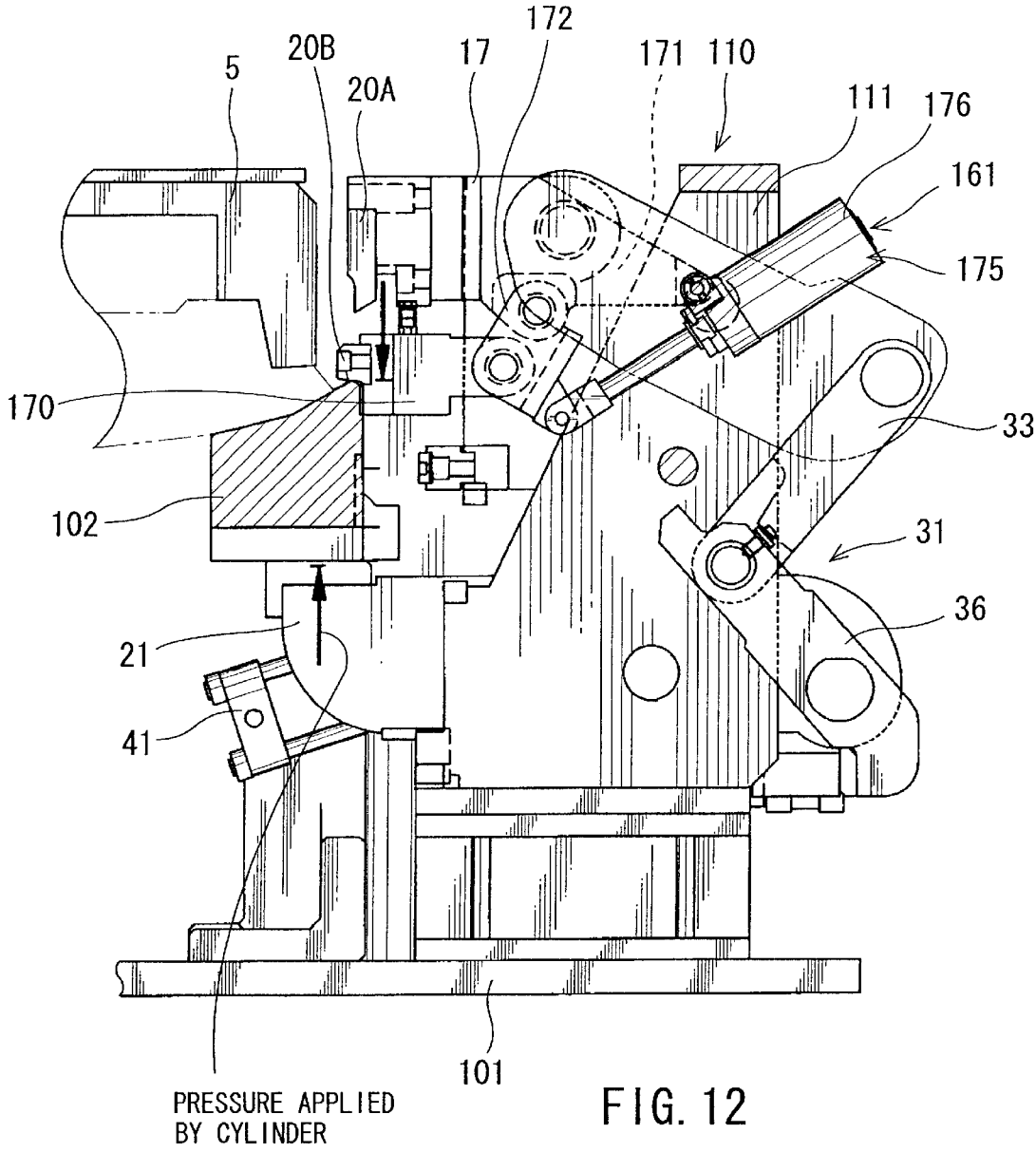
FIG. 12 is a view similar to FIG. 10, but instead, showing the pre-hemming operation performed by the hemming unit.
Figure 13:
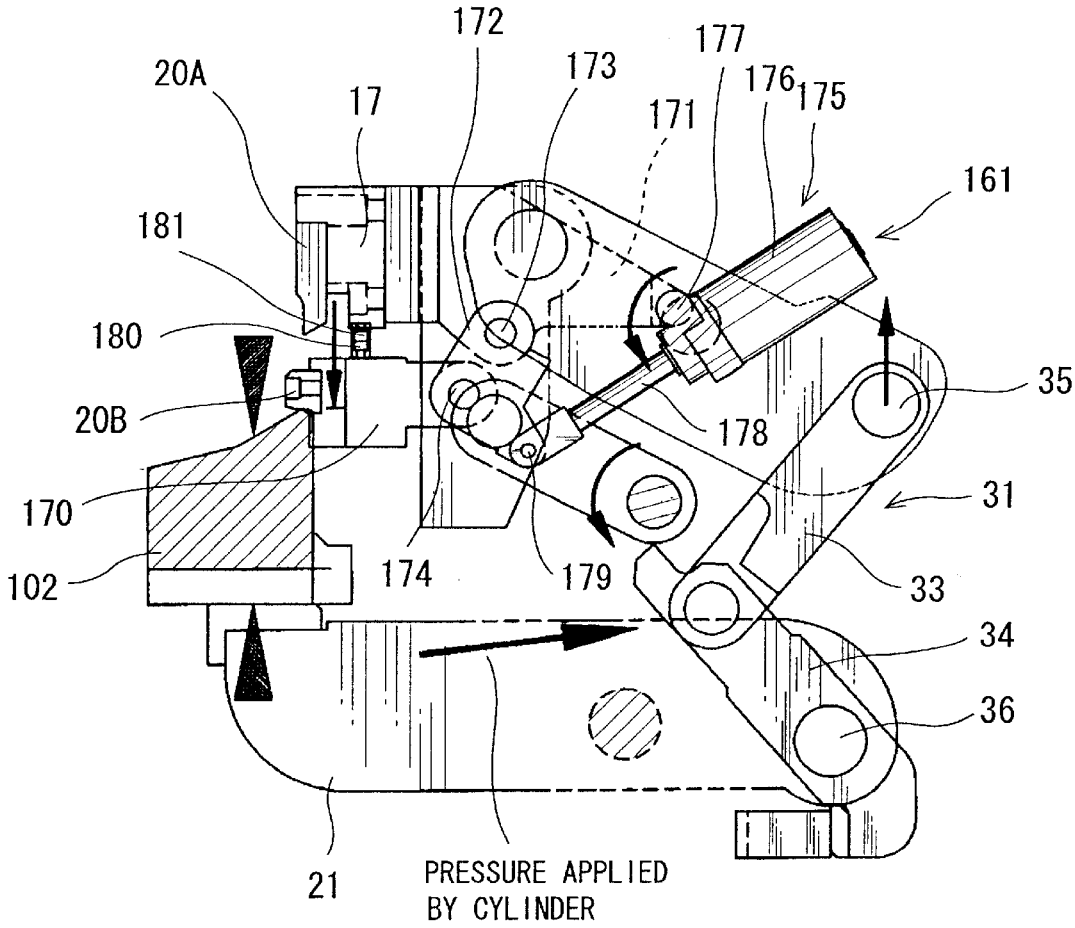
FIG. 13 is a schematic diagram illustrating the pre-hemming operation.
Figure 14:
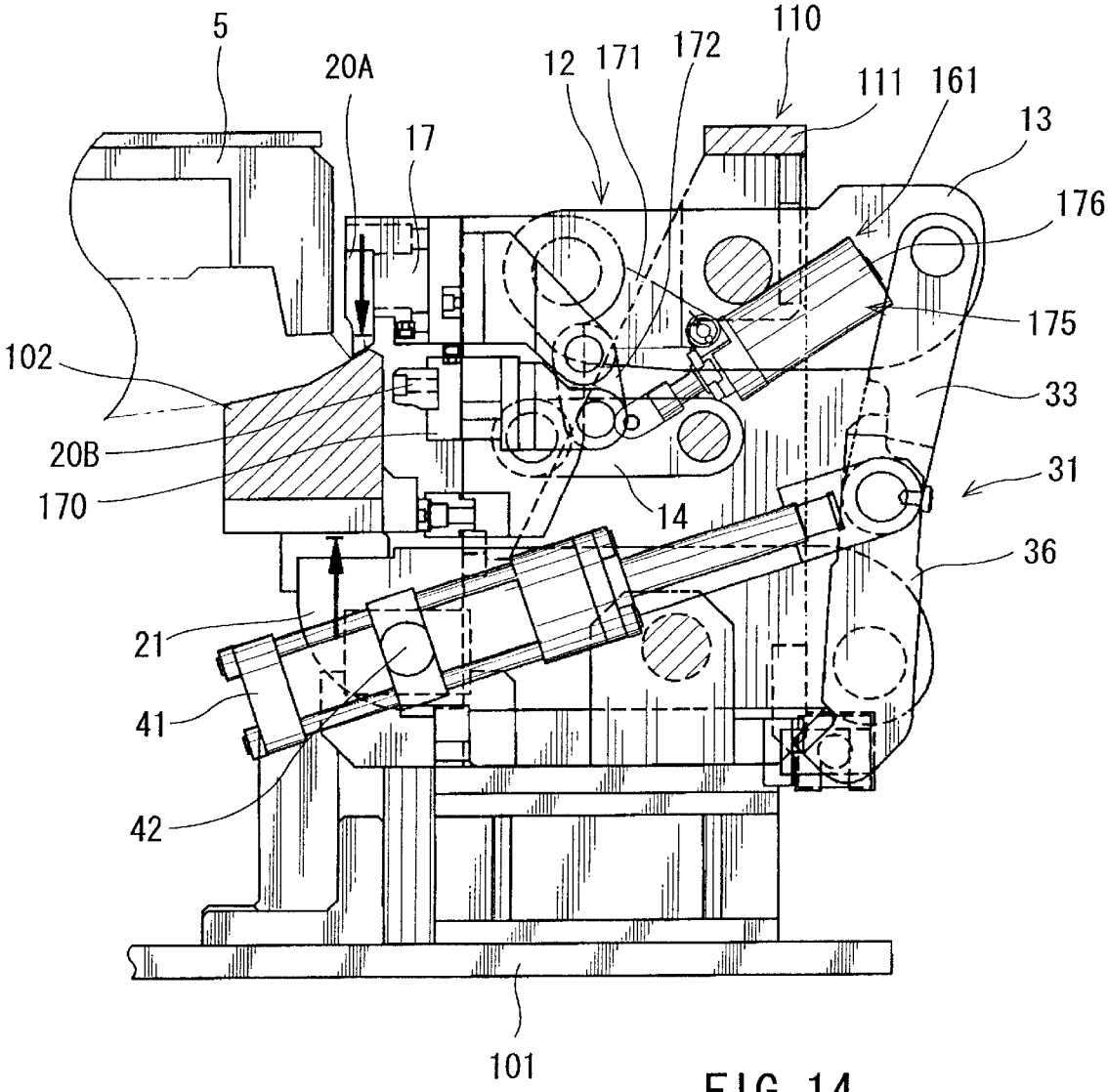
FIG. 14 is a view similar to FIG. 10, but instead, showing the finish hemming operation performed by the hemming unit.
Figure 15:
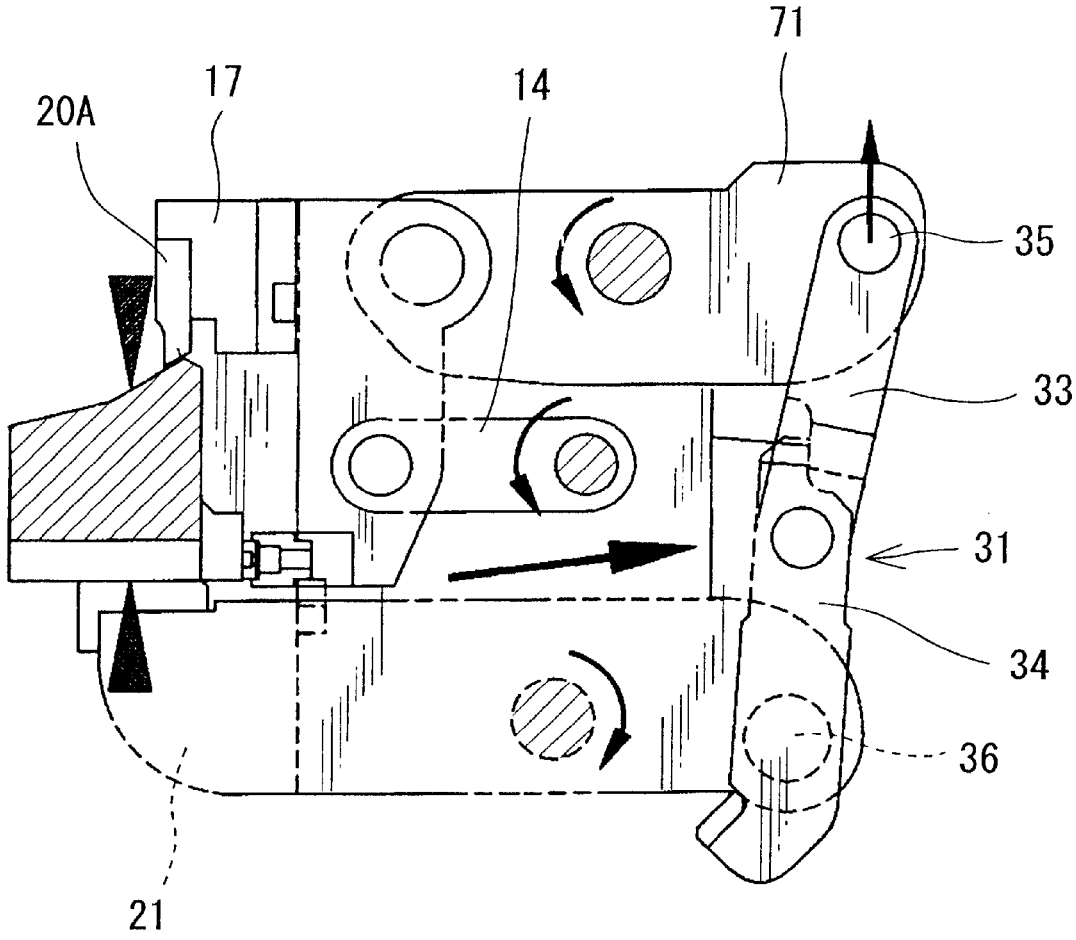
FIG. 15 is a schematic diagram illustrating the finish hemming operation.

Therefore, the cylinder 175 may be operated to move the pre-hemming tool 20B between a pre-hemming position and a finishing position. In the pre-hemming position, the pre-hemming tool 20B may be positioned just below the finish hemming tool 20A (hereinafter called the "pre-hemming position") as shown in FIGS. 11(A), 12 and 13. On the other hand, in the hemming position, the pre-hemming tool 20B may be positioned below and rearward (rightward as viewed in the drawings) of the finish hemming tool 20A (hereinafter called the "finish hemming position") as shown in FIGS. 11(B), 14 and 15.

FIG. 10 shows the hemming unit 110 in a rest position, in which both hemming tools 20A and 20B are positioned away from the workpiece support 102. Also, in the state shown in FIG. 10, the hemming tool 20B is in the finish hemming position. As the piston rod 178 extends, the second tool holder 170 may pivot relative to the bracket 172 around the pivot shaft 174 in the counterclockwise direction. At the same time, the bracket 172 may pivot in the clockwise direction relative to the support plate 171 around the pivot shaft 173. Further, the cylinder 175 also may pivot in the counterclockwise direction relative to the support plate 171 around the pivot shaft 177.

Preferably, the relationship among the distance between the pivot shafts 173 and 174, the distance between the pivot shaft 174 and the pivot pin 179, and the distance between the pivot shafts 173 and 177 is chosen such that the second tool holder 170 is held in substantially parallel to the tool holder 17 during the movement by the piston rod 178. Therefore, the second tool holder 170 may move forward, while the second holder 170 moves up and down in response to change of the position of the pivotal shaft 174 in the vertical direction relative to the support plate 171 or the tool holder 17. When the pre-hemming tool 20B is in the finish hemming position as shown in FIG. 10, the pivot shaft 174 is positioned slightly rearward of the support shaft 173. Therefore, as the piston rod 178 extends, the support shaft 174 first moves downward and then moves upward after passing the position below the support shaft 173.

When the pre-hemming tool 20B reaches the pre-hemming position, a stopper 180 mounted on the upper edge of the second tool holder 170 may abut a stopper 181, which may be, e.g., mounted on the lower edge of the tool holder 17. As a result, the second tool holder 170 may be prevented from moving further upward, so that the pre-hemming tool 20B can be held in the pre-hemming position as shown in FIGS. 11(A), 12 and 13.

On the other hand, when the piston rod 178 retracts, the second tool holder 170 may move downward and then may move upward as the pivot shaft 174, thereby passing the position below the pivot shaft 173. Then, the stopper 180 of the second tool holder 170 may abut the lower edge of the tool holder 17 in a position rearward of the stopper 181. As a result, the pre-hemming tool 20B may return to the hemming position and may be held in this position as shown in FIGS. 10, 11(B), 14 and 15.

As shown in FIGS. 11(A) and 11(B), the representative hemming unit 110 may be adapted to hem a workpiece WA that may be a semi-finished part, such as an automobile door part or hood part, and may include, e.g., an inner panel WA1 and an outer panel WA2. Thus, the hemming operation may be performed to bend an upright peripheral portion WA2*a* of the outer panel WA2 over a peripheral flange WA1*a* of the inner panel WA1 in the same manner as the first representative embodiment. However, in this representative embodiment, the periphery of the outer panel WA, including the peripheral portion WA2*a*, is inclined upward toward the outside. Therefore, an upper peripheral surface 102*a* of the workpiece support 102 may be inclined upward toward the outside to correspond to the configuration of the periphery of the outer panel WA2.

In addition, the finish hemming tool 20A may have a tool surface 20A1 that is inclined to correspond to the configuration of the periphery of the workpiece support 102. Moreover, the pre-hemming tool 20B may have a tool surface 20B1 that is inclined slightly upward in the forward direction (left direction as viewed in FIGS. 11(A) and 11(B)).

A representative method for operating the above second representative hemming apparatus will now be described. First, a workpiece WA may be transferred onto the workpiece support 102 and may be held in position by means of the workpiece holder 5 and the positioning pins 6 (not shown in FIGS. 10 to 15) in the same manner as described in connection with the first representative embodiment. Preferably, when the workpiece WA is being transferred onto the workpiece support 102, each of the hemming units 110 is maintained in the rest position shown in FIG. 10.

After the workpiece WA has been set or placed onto the workpiece support 102, the hemming units 110 may simultaneously start to perform the pre-hemming operation and the finish hemming operation in synchronism with each other. Because the operations performed by the hemming units 110 may be the same, the operation of only one hemming unit 110 will be further explained.

In order to perform the pre-hemming operation, the cylinder 175 (i.e., the driving member of the mode change device 161) is actuated to extend the piston rod 178. Thus, the hemming tool 20B will be positioned and held in the pre-hemming position just below the hemming tool 20A.

Then, the hemming cylinder 41 is actuated to extend the piston rod 44. As a result, the tool holder 17 having the finish hemming tool 20A will move downward toward the workpiece support 102 by means of the toggle link mechanism 31 and the parallel link mechanism 12 in the same manner as the first representative embodiment. Because the pre-hemming tool 20B is held in the pre-hemming position relative to the support plate 171, which support plate 171 is secured to the tool holder 17, the pre-hemming tool 20B also moves downward with the finishing hemming tool 20A.

Because the pre-hemming tool 20B is positioned just below the finish hemming tool 20A, the pre-hemming tool 20B may first reach the workpiece support 102. As a result, the tool surface 20B1 of the pre-hemming tool 20B may contact the upright peripheral portion WA2*a* of the outer panel WA2 of the workpiece WA, so that the upright peripheral portion WA2*a* can be bent and thus, pre-hemmed. At the same time, the chucking arm 21 pivots to apply upward pressure against the workpiece support 102 by means of the presser plate 23 in the same manner as described in connection with the first representative embodiment. Therefore, the pre-hemming operation can be performed while the backup pressure is applied to the workpiece support 102 in order to cancel or match the pressure applied to the workpiece WA by the pre-hemming tool 20B.

When the pre-hemming operation has been completed, the stopper plate 34*a* of the lower link member 34 contacts the stopper block 51, so that the pre-hemming tool 20B can be stopped at an appropriate level. FIG. 13 schematically shows the hemming unit 110 during the pre-hemming operation.

After completion of the pre-hemming operation, the hemming cylinder 41 is actuated to return the hemming unit 110 to the rest position. As a result, the hemming tools 20A and 20B and the presser plate 23 are moved away from the workpiece support 102.

In order to perform the finish hemming operation, the cylinder 175 of the mode change device 161 is operated to retract the piston rod 178, so that the pre-hemming tool 20B can be set to the finish hemming position as shown in FIG. 10. Then, the hemming cylinder 41 is actuated to extend the piston rod 44, so that the tool holder 17 with the finish hemming tool 20A moves downward toward the workpiece support 102 by means of the toggle link mechanism 31 and the parallel link mechanism 12 in the same manner as described in connection with the pre-hemming operation.

However, the pre-hemming tool 20B is held in the hemming position and is displaced downward and rearward from the finish hemming tool 20A. Therefore, the pre-hemming tool 20B preferably does not contact the workpiece WA as well as the workpiece support 102. Instead, the tool surface 20A1 of the finish hemming tool 20A contacts the pre-hemmed peripheral portion WA2*a* of the outer panel WA2 of the workpiece WA, so that the peripheral portion WA2*a* can be further bent over the flange portion WA1*a* of the inner panel WA1 as shown in FIG. 11(B). The finish hemming operation also may be performed while applying upward pressure against the workpiece support 102 by means of the presser plate 23.

When the finish hemming operation has been completed, the extension 55 of the toggle link member 55 will enter the recess 54 of the upper toggle link member 54 and will contact the bottom of the recess 54. Therefore, the downward movement of the finish hemming tool 20A can be stopped at an appropriate level. FIG. 15 schematically shows the hemming unit 110 during the finish hemming operation.

After completion of the finish hemming operation, the piston rod 44 of the hemming cylinder 41 retracts, so that the hemming tool 20A and 20B and the presser plate 23 return to the respective rest position shown in FIG. 10. The finished workpiece WA can be removed from the hemming unit 110 in the same manner as the first representative embodiment.

According to the second representative hemming apparatus, the following features may be provided in addition to the features of the first representative embodiment:

(1) Because the finishing hemming tool 20A and the pre-hemming tool 20B are separately provided, the accuracy of the pre-hemming and finish hemming operations can be easily and reliably maintained. Thus, according to the integral hemming tool 20 of the first representative embodiment, if one of the pre-hemming tool surface 20*a* and the finish hemming tool surface 20*b* has been worn or damaged, the surface 20*a* or 20*b* must be machined to restore the proper surface configuration. However, if such a machining operation has been performed for one of the surfaces 20*a* and 20*b*, the positional relationship between these surfaces 20*a* and 20*b* may be changed. As a result, the accurately of the hemming operation may be degraded if the position of the hemming tool 20 has been set based on either the surface 20*a* or the surface 20*b*.

(2) Because the unit bracket 111 is fixed in position relative to the support base 101, the positions of the hemming cylinder 41, the toggle link mechanism 31 and the chucking arm 21 will not be changed irrespective of changes between the pre-hemming mode and the finish hemming mode. Therefore, the chucking arm 21 can perform the backup operation of the workpiece support 102 at a fixed position relative to the workpiece support 102. Therefore, the backup operation can be reliably performed. In addition, the construction of the hemming apparatus can be simplified, because it is not necessary to move the unit brackets 111.

What is claimed is:

1. A hemming unit comprising:

a hemming tool;

an actuator for moving the hemming tool, a link mechanism connecting the actuator and the hemming tool, and a workpiece support, wherein the hemming tool is adapted to hem the workpiece that is supported on the workpiece support, and a force canceling device comprising a drive device, wherein the force canceling device applies a pressing force against the workpiece support in a direction substantially opposite to a pressing force applied to the workpiece support via the workpiece by the hemming tool, said pressing force being applied substantially simultaneously with the application of the pressing force against the workpiece by the hemming tool during the hemming operation, whereby the pressing force applied to the workpiece support by the hemming tool can be canceled or matched.

2. A hemming unit comprising:

a hemming tool;

an actuator for moving the hemming tool;

a link mechanism connecting the actuator and the hemming tool;

a workpiece support, the hemming tool being adapted to hem the workpiece that is supported on the workpiece support;

a force canceling device that applies a pressing force against the workpiece support in a direction substantially opposite to a pressing force applied to the workpiece support via the workpiece by the hemming tool during the hemming operation, whereby the pressing force applied to the workpiece support by the hemming tool can be canceled or matched;

wherein the hemming tool includes a first surface for a pre-hemming operation of a workpiece and a second surface for a finish hemming operation of the workpiece, wherein the hemming unit is operable in a first mode to pre-hem the workpiece using the first surface and in a second mode to finish hem the workpiece using the second surface;

wherein the actuator also serves as the drive of the force canceling device, so that the force canceling device applies the pressing force against the workpiece support substantially simultaneously with the application of the pressing force against the workpiece by the hemming tool.

3. A hemming unit as in claim 2, wherein the link mechanism includes a toggle link mechanism that includes a first link member coupled to the hemming tool and a second link member coupled to the force canceling device.

4. A hemming unit as in claim 3, wherein the link mechanism further includes a parallel link mechanism that is connected between the hemming tool and the first link member of the toggle link mechanism.

5. A hemming unit as in claim 3, wherein the force canceling device includes a chucking arm having a first end and a second end, wherein the first end of the chucking arm is coupled to the second link member of the toggle link mechanism, and the second end of the chucking arm contacts the workpiece support to apply the pressing force against the workpiece support.

6. An apparatus for hemming a workpiece comprising:

a workpiece support having a first surface and a second surface, the first surface being adapted to support the workpiece during a hemming operation, a workpiece holder adapted to retain the workpiece against the first surface of the workpiece support during the hemming operation, a hemming tool comprising a pre-hemming surface and a finish hemming surface, a hydraulic cylinder, a parallel link mechanism coupled to the hemming tool, a chucking arm arranged and constructed to contact the second surface of the workpiece support during the hemming operation, a toggle mechanism coupling a force generated by the hydraulic cylinder to (1) the hemming tool via the parallel link mechanism and (2) the chucking arm and means for shifting the position of the hemming tool with respect to the workpiece in order to first perform a pre-hemming operation using the pre-hemming surface of the hemming tool and then perform a finish hemming operation using the finish hemming surface of the hemming tool.

7. An apparatus as in claim 6, wherein the apparatus is arranged and constructed such that the force applied to the first surface of the workpiece support by the hydraulic cylinder via the hemming tool and the parallel link mechanism substantially cancels or offsets the force applied to the second surface of the workpiece support via the chucking arm and the toggle mechanism.

8. An apparatus as in claim 7, further comprising a base supporting the workpiece support, wherein the hydraulic cylinder is disposed within a clearance defined between the workpiece support and the base.

9. A method of hemming a workpiece comprising: supporting a second surface the workpiece, forcibly pressing a pre-hemming surface of a hemming tool against a first surface of the workpiece in order to partially bend a peripheral portion of the workpiece, simultaneously forcibly supporting the second surface of the workpiece so as to substantially offset the force applied to the first surface of the workpiece, shifting the orientation of the hemming tool relative to the peripheral portion of the workpiece that was bent, forcibly pressing a finishing surface of the hemming tool against the first surface of the workpiece in order to further bend the peripheral portion of the workpiece and simultaneously forcibly supporting the second surface of the workpiece so as to substantially offset the force applied to the first surface of the workpiece.

10. A workpiece hemming apparatus comprising: means for supporting a second surface the workpiece, means for forcibly pressing a pre-hemming surface of a hemming tool against a first surface of the workpiece in order to partially bend a peripheral portion of the workpiece, means for simultaneously forcibly supporting the second surface of the workpiece so as to substantially offset the force applied to the first surface of the workpiece, means for shifting the orientation of the hemming tool relative to the peripheral portion of the workpiece that was partially bent, means for forcibly pressing a finishing surface of the hemming tool against the first surface of the workpiece in order to further bend the peripheral portion of the workpiece and means for simultaneously forcibly supporting the second surface of the workpiece so as to substantially offset the force applied to the first surface of the workpiece.

11. A hemming unit comprising:

a first hemming tool and a second hemming tool;

an actuator for moving the first and second hemming tools; and a link mechanism connecting the actuator and at least one of the first and second hemming tool; and a mode change device arranged and constructed to change the operation mode of the hemming unit between a pre-hemming mode and a finish hemming mode, the mode change device being further arranged and constructed to change the positions of the first and second hemming tools relative to each other in response to changes in the operation mode wherein the mode change device includes a second actuator and a second link mechanism and wherein one of the first and second hemming tools can be moved so as not to interfere with the hemming operation when the other hemming tool is used.

12. A hemming unit as in claim 11, wherein the second link mechanism is associated with the link mechanism for moving one of the hemming tools.

13. A hemming unit as in claim 11, further including a fixed unit frame for supporting the actuator and the link mechanism.

14. A hemming unit as in claim 1, wherein the actuator further includes a crank mechanism coupled to an electric motor.

15. A hemming unit as in claim 1, wherein the actuator comprises an electric motor.

* * * * *

UNITED STATES PATENT AND TRADEMARK OFFICE

CERTIFICATE OF CORRECTION

PATENT NO. : 6,745,608 B2
APPLICATION NO. : 10/016775
DATED : June 8, 2004
INVENTOR(S) : Takahisa Miura It is certified that error appears in the above-identified patent and that said Letters Patent is hereby corrected as shown below:

On the title page, Item [73] Assignee should read

Column 1 (73) Assignees: Shinkoh Co., Ltd.
Hiroshi Watanabe
Shinkoh Mechanic Co., Ltd.

Signed and Sealed this

Twenty-fifth Day of March, 2008

JON W. DUDAS
*Director of the United States Patent and Trademark Office*